US011591849B2

(12) United States Patent
Roberts et al.

(10) Patent No.: US 11,591,849 B2
(45) Date of Patent: Feb. 28, 2023

(54) DRAW BAR AND BRAKE ARRANGEMENT FOR A DRAW BAR

(71) Applicant: FREEDOM SCREENS CAPITAL PTY LTD, Surfers Paradise (AU)

(72) Inventors: Anthony Gerard Roberts, Currumbin Waters (AU); Aaron Rodd, Currumbin Waters (AU)

(73) Assignee: FREEDOM SCREENS CAPITAL PTY LTD

( * ) Notice: Subject to any disclaimer, the term of this patent is extended or adjusted under 35 U.S.C. 154(b) by 0 days.

(21) Appl. No.: 16/980,962

(22) PCT Filed: Mar. 15, 2019

(86) PCT No.: PCT/AU2019/050235

§ 371 (c)(1),
(2) Date: Sep. 15, 2020

(87) PCT Pub. No.: WO2019/173880

PCT Pub. Date: Sep. 19, 2019

(65) Prior Publication Data

US 2020/0408037 A1 Dec. 31, 2020

(30) Foreign Application Priority Data

Mar. 16, 2018 (AU) ..... 2018900879

(51) Int. Cl.
*E06B 9/54* (2006.01)
*E06B 9/42* (2006.01)
(Continued)

(52) U.S. Cl.
CPC ..... *E06B 9/54* (2013.01); *E06B 9/42* (2013.01); *E06B 9/522* (2013.01); *E06B 9/90* (2013.01);
(Continued)

(58) Field of Classification Search
CPC ... E06B 9/54; E06B 9/42; E06B 9/522; E06B 9/90; E06B 2009/543; E06B 2009/807;
(Continued)

(56) References Cited

U.S. PATENT DOCUMENTS 1,444,419 A * 2/1923 Hoyt ..... E06B 9/58 160/282
1,446,747 A * 2/1923 Hoyt ..... E06B 9/58 160/282
(Continued)

FOREIGN PATENT DOCUMENTS

AU 200154068 A1 1/2002
AU 2010241510 A1 6/2011
(Continued)

OTHER PUBLICATIONS

International Search Report for PCT/AU2019/050235 dated Jun. 24, 2019; 5 pages.

*Primary Examiner* — Daniel P Cahn
*Assistant Examiner* — Matthew R. Shepherd
(74) *Attorney, Agent, or Firm* — Joseph H. Karlin

(57) ABSTRACT

A brake arrangement, for a retractable screen arrangement in which the a screen roller applies a retraction force to the screen and brake arrangement, includes a brake arrangement, for providing a braking force between the brake arrangement and a track which guides the brake arrangement, to resist retraction. The brake arrangement provides a brake member with a friction surface for contacting the bearing surface; a brake member support for supporting the brake member; and a forcing arrangement for forcing the friction surface against the bearing surface. The forcing arrangement includes a biasing arrangement for biasing the friction surface onto the bearing surface, and a force-increasing arrangement for increasing the force with which the friction surface engages the bearing surface. The force
(Continued)

increasing arrangement converts a frictional force between the friction surface and the track into additional contact pressure force of the friction surface onto the guide track.

18 Claims, 17 Drawing Sheets

(51) Int. Cl.
*E06B 9/52* (2006.01)
*E06B 9/90* (2006.01)
*E06B 9/80* (2006.01)

(52) U.S. Cl.
CPC ... *E06B 2009/543* (2013.01); *E06B 2009/807* (2013.01)

(58) Field of Classification Search
CPC ..... E06B 9/08; E06B 9/17; E06B 9/58; E06B 9/581; E06B 9/80; E06B 2009/801; E06B 2009/805; E06B 9/86
USPC ..... 49/449, 450, 451
See application file for complete search history.

(56) References Cited

U.S. PATENT DOCUMENTS 1,550,691 A * 8/1925 Golden ..... E06B 9/58 160/282
1,784,375 A * 12/1930 Mohun ..... E06B 9/58 160/282
1,787,451 A * 1/1931 Mohun ..... E06B 9/582 160/282
2,134,292 A * 10/1938 Schunk ..... E06B 9/58 160/281
3,842,890 A 10/1974 Kramer
3,911,990 A 10/1975 Hoover et al.
4,359,081 A 11/1982 Brower
4,658,879 A 4/1987 Van Klompenburg
4,821,786 A 4/1989 Johnston
4,825,921 A 5/1989 Rigter
4,884,617 A 12/1989 Coenraets
5,090,468 A 2/1992 Tedeschi
5,868,191 A 2/1999 Blackmon, Jr.
6,082,432 A 7/2000 Kissinger
6,119,758 A 9/2000 Coenraets
6,141,913 A * 11/2000 Wong ..... E05D 15/22 49/183
6,256,931 B1 * 7/2001 Kenkel ..... E06B 3/44 160/90
6,405,781 B2 6/2002 Davies et al.
6,408,922 B2 6/2002 Desrochers
6,463,983 B1 10/2002 Lang
6,478,070 B2 11/2002 Poppema
6,607,221 B1 * 8/2003 Elliott ..... E05B 65/0876 292/33
6,629,555 B2 10/2003 DeBlock et al.
6,701,994 B2 3/2004 Goldenberg et al.
6,758,503 B2 7/2004 Sadler
6,854,505 B2 2/2005 Grubb et al.
6,899,380 B2 5/2005 Kralik et al.
6,959,748 B2 11/2005 Hudoba
7,017,644 B1 3/2006 Kraeutler
7,100,667 B2 9/2006 Tomita
7,210,513 B2 5/2007 Goldenberg et al.
7,275,581 B2 10/2007 Coenraets
7,370,685 B2 5/2008 Moriya et al.
7,487,816 B2 2/2009 Moriya et al.
7,669,634 B2 3/2010 Sugiyama et al.
7,841,377 B2 11/2010 Coenraets
7,861,761 B2 1/2011 Martineau et al.
7,967,052 B2 6/2011 Lin
8,011,413 B2 9/2011 Poppema
8,196,638 B2 6/2012 Roberts et al.
8,371,355 B2 2/2013 Santoro et al.
8,516,728 B2 8/2013 Jung
8,528,623 B2 9/2013 Roberts
8,656,978 B2 2/2014 Goldenberg et al.
8,662,138 B2 3/2014 Komatsu et al.
8,672,014 B2 3/2014 Coenraets
2001/0042346 A1 11/2001 Brioschi
2004/0107655 A1 * 6/2004 Hudoba ..... E06B 9/90 52/202
2005/0098276 A1 5/2005 Agliolo Quartalaro
2005/0230065 A1 10/2005 Moriya et al.
2005/0274462 A1 12/2005 Nyffenegger et al.
2006/0289120 A1 12/2006 Pielmeier
2007/0029049 A1 2/2007 Martineau
2009/0236050 A1 9/2009 Marzilli
2010/0101739 A1 4/2010 Coenraets
2010/0326605 A1 12/2010 Guillen Chico
2011/0114272 A1 * 5/2011 Roberts ..... E06B 9/54 160/293.1
2012/0061032 A1 3/2012 Snyder et al.
2012/0098301 A1 4/2012 Nakamura et al.
2012/0193045 A1 8/2012 Lin
2013/0112358 A1 * 5/2013 Hardison, III ..... E06B 9/86 160/340
2014/0041814 A1 2/2014 Roberts
2014/0262084 A1 9/2014 Fleischman
2015/0361718 A1 12/2015 Hummel

FOREIGN PATENT DOCUMENTS

AU 2010101509 A4 6/2013
AU 2014203018 A1 12/2015
AU 2017268645 A1 6/2018
AU 2017268647 A1 6/2018
AU 2017268654 A1 6/2018
JP 2002004753 A 1/2002
JP 200616815 A 1/2006
JP 200746266 A 2/2007
WO 9413923 A1 6/1994
WO 2011111031 A2 9/2011

* cited by examiner

DRAW BAR AND BRAKE ARRANGEMENT FOR A DRAW BAR

CROSS-REFERENCE TO RELATED APPLICATIONS

This application is a national phase entry under 35 U.S.C. § 371 of International Application No. PCT/AU2019/050235, filed on Mar. 15, 2019, published in English, which claims priority to Australian Patent Application No. 2018900879, filed on Mar. 16, 2018, the disclosures of which are hereby incorporated herein by reference.

FIELD

The present disclosure relates to a draw bar and brake arrangement for a draw bar, and especially but not exclusively to, a draw bar for use with a retractable screen, to draw the screen across an opening. The disclosure extends to a brake arrangement which may be suitable for use in applications other than draw bars.

Definition

In the specification, the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

BACKGROUND

It is known to provide retractable flexible screens which can extend across openings in building structures, such as doors and windows. Some screens, such as those for eliminating or reducing passage of insects, are primarily functional when the associated door or window opening is open. Other types of screens, such as those for eliminating or reducing passage of light, may be used with great utility whether the associated door or window opening is open or closed. Some screens may serve a dual purpose: for example, a screen which is primarily an insect screen may also moderate passage of light and may therefore be useful in its extended position whether the associated door or window opening is open or closed.

In some screen arrangements, for example, screen arrangements for bi-fold or stacking doors, the screen extends and retracts horizontally. It is often desirable to provide a horizontally opening screen capable of extending across an opening that is significantly wider than a standard doorway. For example, bi-fold doors, stacking doors and French doors are often used in conjunction with relatively wide openings.

One type of retractable screen provides a roller to which a first edge region of a flexible screen material is attached and onto which the flexible screen material is wound so that the screen material can be extended from, and retracted back onto, the roller in a direction perpendicular to the axis of the roller and the first edge region of the screen.

The roller is typically fixed in place at the top of a vertically opening screen or at the side of a horizontally opening screen.

The roller may be biased, for example, by a recoil spring, to bias the screen to its retracted position.

The edges of the screen material perpendicular to the first edge region may be constrained in guide tracks. This can assist in avoiding gaps between these edges and the structure defining the opening. For a horizontally opening screen arrangement, upper and lower guide tracks, which are opposed and substantially parallel, may be provided. For a vertically opening screen arrangement, left- and right-side guide tracks which are opposed and substantially parallel, may be provided.

The edge of the screen material opposite the first edge region may be attached to a moveable handle post or draw bar (referred to herein as a 'draw bar') that is moveable between a position closer to the roller, corresponding to a retracted or open configuration of the screen, and a position further from the roller, corresponding to an extended or closed configuration of the screen.

Respective opposed ends of the draw bar may operatively engage with the respective opposed guide tracks so that the guide tracks can guide movement of the draw bar between open and closed positions.

In some situations, it is desirable to position the screen so that it is partially, but not completely closed, that is, to have the screen material extending across part, but not all of the opening. This can be achieved by positioning the draw bar at a desired intermediate position, between the two extremes of its range of movement.

It will be appreciated that the recoil spring of the roller will pull the screen and draw bar to the fully open position of the screen in the absence of some restraining force that prevents retraction. Thus to enable the screen to be positioned, and then stay, partially closed, some mechanism to enable the draw bar to be retained at a desired intermediate position may be required.

One way of allowing the draw bar to be retained at a desired intermediate position is to provide a frictional force between the draw bar and the guide tracks.

The present applicant's earlier application, Australian Patent Application No. 2010241510A1, the entire disclosure of which is incorporated herein by reference, describes a vertically oriented draw bar having upper and lower brake arrangements. The present applicant's earlier application, Australian Patent Application No. 2014203018 A1, the entire disclosure of which is incorporated herein by reference, describes a horizontally oriented draw bar having brake arrangements at each end. Each brake arrangement includes a brake with a shank that is slidingly engaged in a passage of a brake support, and is forced axially in a direction towards the respective guide track, by one or more springs within the draw bar. The brake thus engages the guide track to provide a braking force. The brakes can be moved away from the guide tracks by operation of a handle, the applied force acting against the springs to withdraw the brakes in the axial direction of the draw bar, away from the guide tracks, remove the braking force and allow convenient movement of the draw bar.

However, this brake arrangement has been found, at least sometimes, to provide inadequate braking force to prevent undesired movement of the draw bar in the retraction direction due to the retraction force applied by the biased roller.

Accordingly, it has been discerned that there is a need for an improved or at least alternative means of controlling the movement of a draw bar.

The reference to prior art or other background in this specification is not, and should not be taken as, an acknowledgment or any form of suggestion that the referenced prior art or other background forms part of the common general knowledge in Australia or in any other country.

SUMMARY

According to a first aspect of the present disclosure, there is provided a draw bar for a retractable screen arrangement in which a screen material is extensible across an opening by movement of the draw bar in an extension direction in order to screen or partially screen the opening, and in which the screen material is retractable by movement of the draw bar in a retraction direction, to reduce occlusion of the opening by the screen material and in which the screen arrangement applies a retraction force, in the retraction direction, to the screen material to assist retraction of the screen material;

the draw bar comprising:

a brake arrangement for providing a braking force between the draw bar and a bearing surface of a track which in use guides the draw bar, to resist relative movement of the brake arrangement and the bearing surface in at least one direction, the brake arrangement comprising:

a brake member which provides a friction surface for contacting the bearing surface;

a brake member support for supporting the brake member; and a forcing arrangement for forcing the friction surface against the bearing surface;

wherein the forcing arrangement comprises: a biasing arrangement for biasing the friction surface towards the bearing surface, and a force-increasing arrangement for increasing the force with which the friction surface engages the bearing surface.

In an embodiment, the force-increasing arrangement is configured to increase the force with which the friction surface engages the bearing surface by converting at least some of a frictional force applied between the friction surface and the bearing surface into additional contact pressure force applied to the brake member to increase contact pressure between the friction surface and the bearing surface.

In an embodiment, increasing the force with which the friction surface engages the bearing surface corresponds to increasing the force with which the friction surface is forced onto the bearing surface.

In an embodiment, the force-increasing arrangement comprises a forcing part having a first region connected to the brake member support, a second region connected to the brake member, and an intermediate region for transmitting force between the first region and the second region.

In an embodiment, at least part of the forcing part is angled relative to the extension direction.

In an embodiment, at least part of the forcing part is angled relative to the extension direction, so that when a frictional force between the bearing surface and the friction member is applied to the forcing part in the extension direction, the forcing part provides a reaction force which forces the friction surface onto the bearing surface.

In an embodiment, at least part of the forcing part is angled relative to the extension direction, so that when a frictional force between the bearing surface and the friction member is applied to the forcing part in the extension direction, the forcing part provides a reaction force with a component directed towards the bearing surface.

In an embodiment, the forcing part comprises a brake member coupling which couples the brake member to the brake member support so that movement of at least the friction surface of the brake member relative to the brake member support is constrained by the brake member coupling to movement which has a component in the extension-retraction direction and a component towards or away from the bearing surface.

In an embodiment, the forcing part comprises a brake member coupling which couples the brake member to the brake member support so that movement of at least the friction surface of the brake member relative to the brake member support is constrained by the brake member coupling to movement which has a component in an axial direction of the brake member support, and a component in perpendicular to the axial direction of the brake member support.

In an embodiment, the forcing part comprises a brake member coupling which couples the brake member to the brake member support so that movement of at least the friction surface of the brake member relative to the brake member support is constrained by the brake member coupling to movement which follows a curved path.

In an embodiment, the forcing part comprises a brake member coupling which couples the brake member to the brake member support so that movement of at least the friction surface of the brake member relative to the brake member support is constrained by the brake member coupling to movement which follows a substantially arcuate path.

In an embodiment, the brake member coupling comprises at least one link member.

In an embodiment, the at least one link member is operatively coupled to the brake member and to the brake member support.

In an embodiment, the at least one link member is pivotably coupled to at least one of the brake member and to the brake member support.

In an embodiment, the at least one link member is pivotably coupled to the brake member and to the brake member support.

In an embodiment, the at least one link member defines a substantially fixed distance between a part of the brake member and a part of the brake member support.

In an embodiment, the at least one link member defines a substantially arcuate path, relative to a part of the brake support member, along which movement of a part of the brake member is constrained.

In an embodiment, the at least one link member defines a substantially arcuate path, relative to a part of the brake support member, along which movement of a connection part of the brake member is constrained.

In an embodiment, the connection part of the brake member is adjacent the friction surface.

In an embodiment, the connection part of the brake member is a first one of a projection or an aperture, which in use is connected to the other of a projection or an aperture provided on the link member.

In an embodiment, the brake member includes an actuating part.

In an embodiment, the actuation part is part of the brake member.

In an embodiment, the actuating part extends away from the friction surface and is controllable by a user to move the friction surface away from the bearing surface, against the force applied by the biasing arrangement.

In an embodiment, movement of the actuating part is guided by the brake member support.

In an embodiment, movement of the actuating part is guided by the actuating part being moveably engaged in a passage provided in the brake member support.

In an embodiment, the biasing arrangement comprises a resilient member arranged to provide a bias force between the brake member support and the brake member.

In an embodiment, the resilient member comprises a spring.

In an embodiment, the resilient member comprises a helical spring maintained in a compressed arrangement, which provides the bias force in its extension direction.

In an embodiment, the resilient member is oriented in a direction which extends from a part of the brake member support towards the friction surface.

In an embodiment, a first part of the resilient member applies a force against a part of the brake member support, and a second part of the resilient member applies a force against a part of the brake member, so as to apply the bias force by forcing apart said part of the brake member support and said part of the brake member.

In an embodiment, the at least one link member is offset laterally from the friction surface.

In an embodiment, the brake assembly provides at least one link member towards each lateral side of the brake assembly.

In an embodiment, the brake assembly provides at least one link member on each lateral side of the friction surface.

In an embodiment, the brake arrangement further comprises a latch arrangement, for engagement with a catch provided adjacent the bearing surface.

In an embodiment, the latch arrangement comprises a latch member moveable by the brake member from a latching position to a disengaging position.

In an embodiment, an action by a user which moves the friction surface into a withdrawn position also moves the latch into the disengaging position.

In an embodiment, the brake arrangement includes a base region defining a cavity which, in use, retains at least part of a rail portion of a guide track therein.

In an embodiment, the cavity has a wider main part, and a narrower entrance part, so that the cavity is adapted to retain therein a guide rail which has a wider terminal region which is too wide to pass through the entrance part of the cavity, and a narrower region connected to the terminal region, the narrower region being adapted to be slideably retained in the entrance part of the cavity.

In an embodiment, the cavity is adapted to retain therein the guide rail therein so that even in the event of a large force being applied to the bearing surface by the brake member, the brake support is not substantially forced away from the guide rail by said large force.

In an embodiment, application of a large force being applied to the bearing surface by the brake member substantially clamps the guide rail between the friction surface and a part of the base region at or adjacent the narrower entrance part of the cavity.

According to a second aspect of the present disclosure, there is provided a draw bar for a retractable screen arrangement in which a screen material is extensible across an opening by movement of the draw bar in an extension direction in order to screen or partially screen the opening, and in which the screen material is retractable by movement of the draw bar in a retraction direction, to reduce occlusion of the opening by the screen material and in which the screen arrangement applies a retraction force, in the retraction direction, to the screen material to assist retraction of the screen material;

the draw bar comprising:

a brake arrangement for providing a braking force between the draw bar and a bearing surface of a track which in use guides the draw bar, to resist relative movement of the brake arrangement and the bearing surface in at least one direction, the brake arrangement comprising:

a brake member which provides a friction surface for contacting the bearing surface;

a brake member support for supporting the brake member; and a forcing arrangement for forcing the friction surface against the bearing surface;

the forcing arrangement comprising a force-increasing arrangement for increasing the force with which the friction surface engages the bearing surface by converting at least some of a frictional force applied between the friction surface and the bearing surface into additional contact pressure force applied to the brake member to increase contact pressure between the friction surface and the bearing surface.

In an embodiment, the forcing arrangement further comprises a biasing arrangement for biasing the friction surface towards the bearing surface.

In an embodiment, the biasing arrangement operates independent of whether the force-increasing arrangement is actively increasing the force with which the friction surface engages the bearing surface by converting at least some of a frictional force applied between the friction surface and the bearing surface into additional contact pressure force applied to the brake member.

It will be appreciated that characteristics and features described above in relation to embodiments related to the first aspect may also be incorporated into the draw bar of the second aspect.

According to a third aspect of the present disclosure, there is provided a brake arrangement for a draw bar of a retractable screen arrangement in which a screen material is extensible across an opening by movement of the draw bar in an extension direction in order to screen or partially screen the opening, and in which the screen material is retractable by movement of the draw bar in a retraction direction, to reduce occlusion of the opening by the screen material and in which the screen arrangement applies a retraction force, in the retraction direction, to the screen material to assist retraction of the screen material;

the brake arrangement being for providing a braking force between the draw bar and a bearing surface of a track which in use guides the draw bar, to resist relative movement of the brake arrangement and the bearing surface in at least one direction, the brake arrangement comprising:

a brake member which provides a friction surface for contacting the bearing surface;

a brake member support for supporting the brake member; and a forcing arrangement for forcing the friction surface against the bearing surface;

wherein the forcing arrangement comprises: a biasing arrangement for biasing the friction surface towards the bearing surface, and a force-increasing arrangement for increasing the force with which the friction surface engages the bearing surface.

It will be appreciated that characteristics and features described above in relation to embodiments related to the first aspect may also be incorporated into the brake arrangement of the third aspect.

According to a fourth aspect of the present disclosure, there is provided a brake arrangement for a draw bar of a retractable screen arrangement in which a screen material is extensible across an opening by movement of the draw bar in an extension direction in order to screen or partially screen the opening, and in which the screen material is retractable by movement of the draw bar in a retraction direction, to reduce occlusion of the opening by the screen material and in which the screen arrangement applies a retraction force, in the retraction direction, to the screen material to assist retraction of the screen material;

the a brake arrangement being for providing a braking force between the draw bar and a bearing surface of a track which in use guides the draw bar, to resist relative movement of the brake arrangement and the bearing surface in at least one direction, the brake arrangement comprising:

a brake member which provides a friction surface for contacting the bearing surface;

a brake member support for supporting the brake member; and a forcing arrangement for forcing the friction surface against the bearing surface, the forcing arrangement comprising a force-increasing arrangement for increasing the force with which the friction surface engages the bearing surface by converting at least some of a frictional force applied between the friction surface and the bearing surface into additional contact pressure force applied to the brake member to increase contact pressure between the friction surface and the bearing surface.

It will be appreciated that characteristics and features described above in relation to embodiments related to the first and/or second aspects may also be incorporated into brake arrangement of the fourth aspect.

According to a fifth aspect of the present disclosure, there is provided a brake arrangement for providing a braking force between a first element, to which the brake arrangement is attached in use, and a second element which provides a bearing surface, the braking force being to resist relative movement of the brake arrangement and the bearing surface in at least one direction by providing a braking force between the first element and the bearing surface, the brake arrangement comprising:

a brake member which provides a friction surface for contacting the bearing surface;

a brake member support for supporting the brake member; and a forcing arrangement for forcing the friction surface against the bearing surface;

wherein the forcing arrangement comprises: a biasing arrangement for biasing the friction surface towards the bearing surface, and a force-increasing arrangement for increasing the force with which the friction surface engages the bearing surface.

It will be appreciated that characteristics and features described above in relation to embodiments related to the first aspect may also be incorporated into the brake arrangement of the fifth aspect.

According to a sixth aspect of the present disclosure, there is provided a brake arrangement for providing a braking force between a first element, to which the brake arrangement is attached in use, and a second element which provides a bearing surface, the braking force being to resist relative movement of the brake arrangement and the bearing surface in at least one direction by providing a braking force between the first element and the bearing surface, the brake arrangement comprising:

a brake member which provides a friction surface for contacting the bearing surface;

a brake member support for supporting the brake member; and a forcing arrangement for forcing the friction surface against the bearing surface;

the forcing arrangement comprising a force-increasing arrangement for increasing the force with which the friction surface engages the bearing surface by converting at least some of a frictional force applied between the friction surface and the bearing surface into additional contact pressure force applied to the brake member to increase contact pressure between the friction surface and the bearing surface.

It will be appreciated that characteristics and features described above in relation to embodiments related to the first and/or second aspects may also be incorporated into brake arrangement of the sixth aspect.

BRIEF DESCRIPTION OF THE DRAWINGS

Embodiments will be described below, in detail, with reference to accompanying drawings. The primary purpose of this detailed description is to instruct persons having an interest in the subject matter of the invention how to carry the invention into practical effect. However, it is to be clearly understood that the specific nature of this detailed description. In the accompanying diagrammatic drawings:

FIG. 11(*b*) is a schematic transverse cross sectional view of the draw bar main body illustrated in FIG. 11(*a*);

FIG. 11(*c*) is a schematic perspective view of a draw bar in isolation;

DETAILED DESCRIPTION OF THE DRAWINGS

With reference to the accompanying drawings, embodiments of a brake arrangement will be described. The brake arrangement is described with particular reference to use in a draw bar used for retaining a forward edge of a flexible screen, so that the screen can be drawn across an opening to extend or retract the screen, but it will be appreciated that embodiments of the disclosed brake arrangement could be used for other purposes and in conjunction with other types of apparatus.

Figure 1:
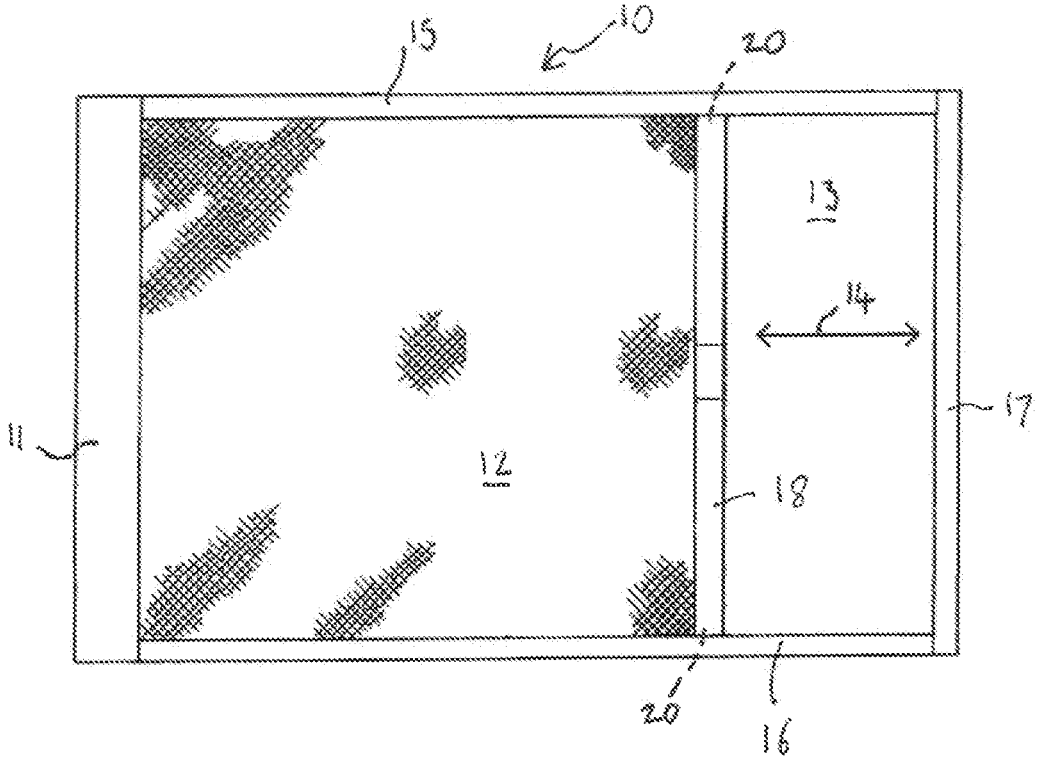
FIG. 1 is a perspective view of a retractable screen assembly including a draw bar.

FIG. 1 illustrates schematically, and by way of example, a screen arrangement 10, comprising a vertically orientated roller cover 11 which houses a vertically orientated roller (not shown) to which a first vertical edge (not shown) of a flexible screen 12 is attached. The flexible screen 12 is wound on the roller so that the screen 12 is extensible across an opening 13, and retractable onto the roller, as indicated by a double headed arrow 14. The roller cover 11, or a frame part (not shown) associated therewith, provides a first upright frame part of the screen arrangement 10. The screen arrangement 10 further comprises an upper guide track 15 which retains an upper edge of the flexible screen 12, a bottom guide track 16 which retains a lower edge of the flexible screen 12, and a second upright frame part 17. The upper and bottom guide tracks 15, 16 extend between the roller cover 11 and the second upright frame part 17. The screen arrangement 10 further comprises a draw bar 18 which is retained between the upper and bottom guide tracks 15, 16 and is moveable substantially between the roller cover 11 and the second upright frame part 17. The draw bar 18 retains a second vertical edge of the flexible screen 12 opposed to the first vertical edge, so that movement of the draw bar extends or retracts the flexible screen 12.

The draw bar 18 may be provided with brake assemblies 20 at its top and bottom to enable the draw bar 18 to be retained at a desired position intermediate the roller cover 11 and the second upright frame part 17 corresponding to a partially closed position of the screen 12.

Figure 2:
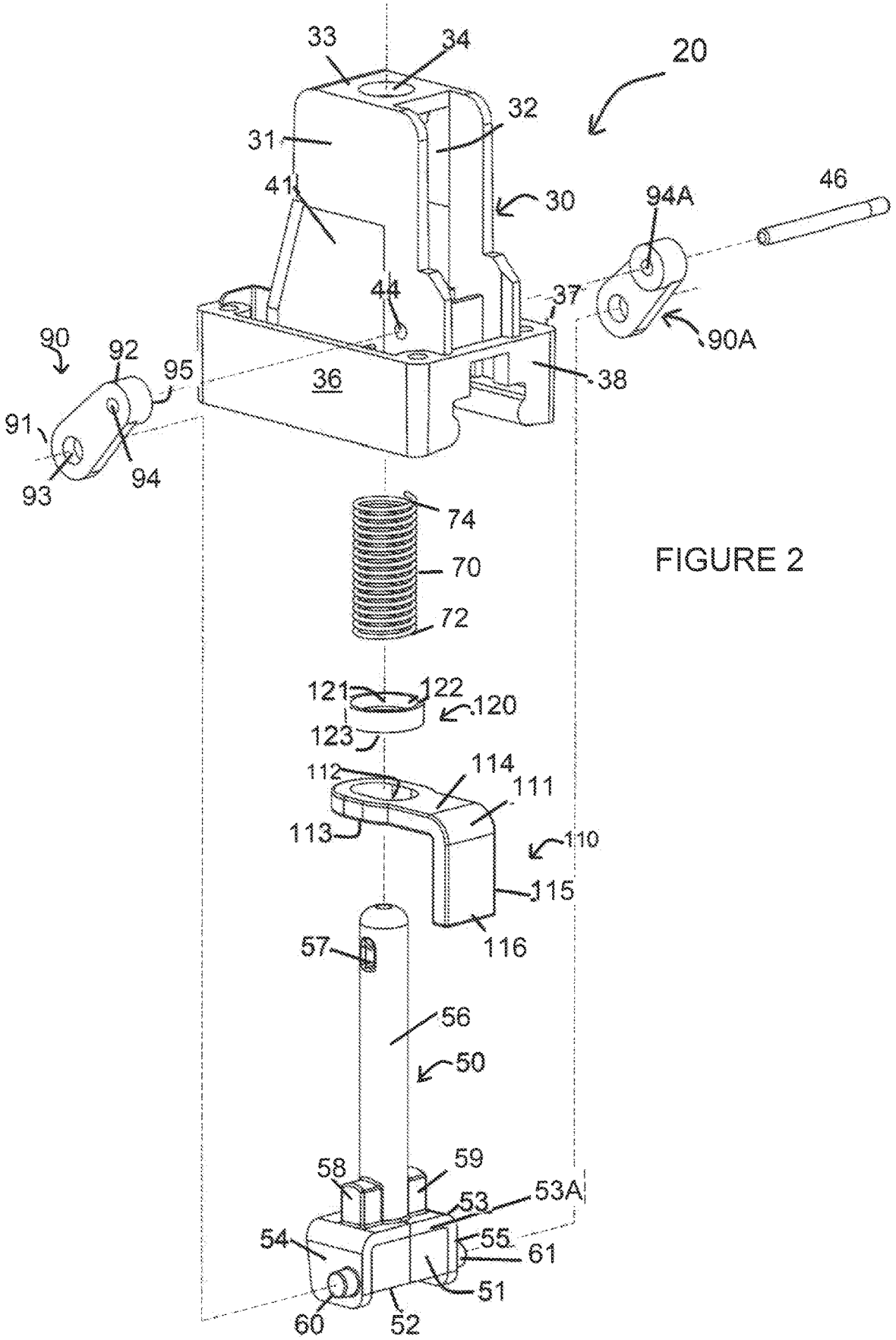
FIG. 2 is an exploded perspective view of a brake assembly suitable for use in the draw bar of a screen assembly of the type illustrated in FIG. 1.
Figure 3:
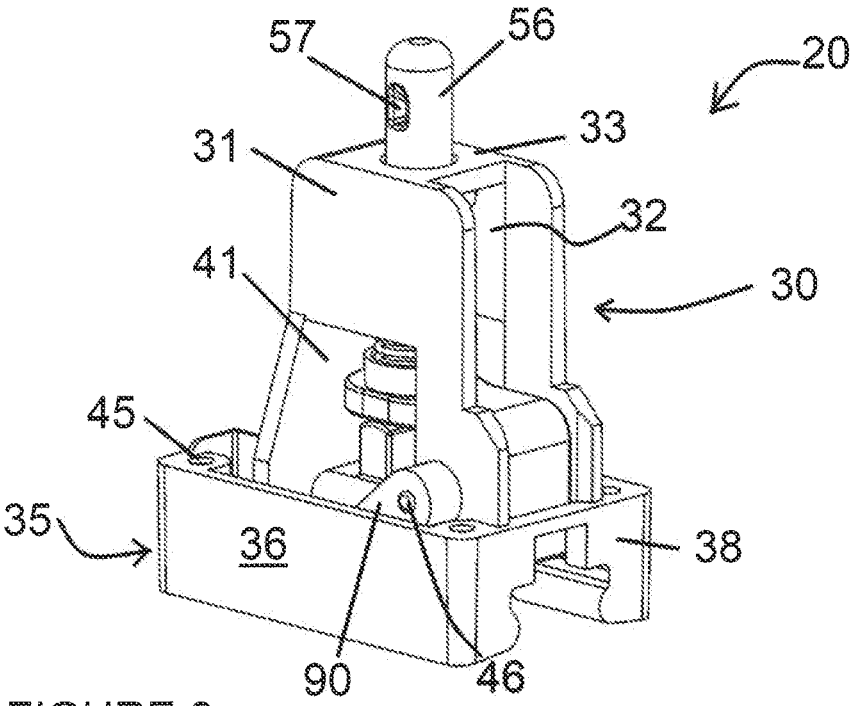
FIG. 3 is a perspective view of the brake assembly of FIG. 2 with a brake member in a fully extended configuration.

FIG. 2 is an exploded perspective view, and FIG. 3 is an assembled view, of a brake assembly, generally designated 20, suitable for use in the draw bar 18 of the type illustrated in FIG. 1.

The brake assembly 20 comprises a brake assembly housing 30, and a brake member 50, which is moveably supported by the brake assembly housing 30. The brake member 50 includes a brake pad 51 which provides a friction surface 52 for engaging a bearing surface, for example a bearing surface (e.g. 436, 438 in FIG. 12) of the bottom guide track 16.

Identical brake assemblies can be used at the top and bottom of the draw bar 18 (or at the respective ends of a horizontally extending draw bar of a vertically extensible screen arrangement). However, for ease of description and understanding, the following detailed description of the brake assembly 20 is with reference to its use at the bottom of the draw bar 18.

It will be appreciated that the draw bar 18 can be moved in an extension direction of the screen and in a retraction direction of the screen, as desired. The brake assembly 20 and housing 30 are may be regarded as having a front or forward side which is the leading side when the draw bar is moved in the extension direction of the screen, and a rear side, which is the following side when the draw bar is moved in the extension direction (and is, of course the leading side when the draw bar is moved in the retraction direction of the screen). Thus a front-rear direction is substantially perpendicular to the direction of elongation of the draw bar, and corresponds to the direction of movement of the draw bar when drawing, or extending, the screen. The front-rear direction also corresponds to the direction of movement of the brake assembly 20 relative to the bearing surface, and the direction in which frictional forces between the friction surface 52 and the bearing surface may be considered to be directed.

Thus the brake member 50 can be moved substantially in the direction of elongation of the draw bar, which may also be regarded as an axial direction of the brake assembly 20, and of the housing 30, in order to engage or disengage the brake. The axial direction is also, in use, a direction substantially perpendicular, or normal, to the bearing surface. The axial direction substantially towards the bearing surface may be referred to herein as the first axial direction. The first axial direction is downwards in accompanying drawings, which illustrate the brake assembly orientated as if for use at the bottom of a draw bar, but would be upwards if the brake assembly 20 were oriented for use at the top of a draw bar. The axial direction substantially away from the bearing surface may be referred to herein as the second axial direction.

The brake assembly 20 further comprises a spring 70 for providing a bias force between the housing 30 and the brake member 50. The spring 70 has a first end 72, which, in use, is closer to, and applies a force (generally in the first axial direction) towards, the friction surface 52, and a second end 74 which, in use, is further from the bearing surface 52. The second end 74, in use, may be regarded as applying a force against the housing 30 in a direction oriented away from the bearing surface 52 (generally in the second axial direction). The spring 70 is, in use, maintained under compression so that it applies a bias force between the housing 30 and the friction surface 52. In use, the bias force provided by the spring 70 forces the friction surface 52 towards, and into engagement with, a bearing surface, for example, a bearing surface of the bottom guide track 16.

It will be appreciated that forced engagement of the friction surface 52 against the bearing surface (along with suitable choices of materials) results in a frictional force between the friction surface 52 and the bearing surface, which can be utilised as a braking force to retard or prevent undesired movement of the draw bar.

Thus, in the illustrated embodiment, the engagement of the friction surface 52 against the bearing surface resulting from the bias force applied by the spring 70 can provide a braking force to counteract the force applied to a screen and draw bar in the retraction direction by a biased roller. The braking force can be useful to retard or prevent undesired movement of the draw bar in the retraction direction and can often be sufficient to allow the screen to be maintained in a partially open position.

The brake member can be withdrawn away from the bearing surface to remove the braking force and allow the draw bar to be easily moved, when desired. In the illustrated embodiment, the brake member 50 can be manually forced against the bias force applied by the spring 70 (compressing the spring, as will be described in more detail in due course). Thus the brake member 50 can be moved in the direction of elongation of the draw bar, which may also be regarded as an axial direction of the housing 30 in order to engage or disengage the brake. The direction of elongation of the draw bar is also, in use, a direction perpendicular, or normal, to the bearing surface.

While the braking force resulting from the friction surface 52 being forced against the bearing surface by the bias force applied by the spring 70 can often be sufficient to counteract the retraction force applied by a biased roller, it has been found that such a braking force is sometimes insufficient. The illustrated embodiment provides a force-increasing arrangement which can increase the force with which the friction surface 52 of the brake pad 51 engages the bearing surface.

It will be appreciated that in the illustrated embodiment, in addition to being moveable in the axial direction of the housing 30, the brake member 50 also has some freedom to move, relative to the housing 30, in the front-rear direction, which is perpendicular to the direction of elongation of the draw bar, and which corresponds to the direction of movement of the draw bar corresponding to drawing and retracting the screen. The front-rear direction also corresponds to the direction of movement of the brake assembly 20 relative to the bearing surface and the direction in which frictional forces between the friction surface 52 and the bearing surface may be considered to be directed.

The brake assembly 20 further comprises at least one link member 90, which in use provides part of a force-increasing arrangement which can increase the force with which the friction surface 52 of the brake pad 51 engages the bearing surface. In use, the increased engagement force increases the frictional force between the friction surface 52 and the bearing surface, thus providing more effective braking (at least in some circumstances) than would be provided if the engagement force were solely, or substantially solely, the bias force provided by the spring 70. The force-increasing arrangement converts at least some of a frictional force applied between the friction surface 52 and the bearing surface into additional contact pressure force applied to the brake member 50, thus increasing the engagement force, or contact pressure, between the friction surface 52 and the bearing surface. The increased engagement force, or contact pressure results in increased frictional force between the friction surface 52 and the bearing surface, thus providing more effective braking.

In the illustrated embodiment, the at least one link member 90 may be regarded as constraining movement of the brake member 50 relative to the housing 30 to a substantially predetermined path (as will be described in more detail hereafter). The substantially predetermined path has a direction component in the direction normal to the bearing surface (the axial direction of the housing and/or the direction of elongation of the draw bar) and a direction component in the direction of the frictional force which in use occurs between the friction surface 52 and the bearing surface.

The predetermined path is arranged and oriented so that a frictional force between the friction surface 52 and the bearing surface (e.g. 436, 438), can force and/or move the brake member 50 along part of the predetermined path, and so that this forcing and/or movement along the predetermined path forces and/or moves the brake member 50 towards the bearing surface. Thus it will be understood that the force-increasing arrangement can be regarded as converting at least some of the frictional force, applied in a direction perpendicular to the axis of elongation of the draw bar 18, into a force with a component perpendicular to the axis of elongation of the draw bar, thus increasing the engagement force, or contact pressure, between the friction surface 52 and the bearing surface.

Figure 4:
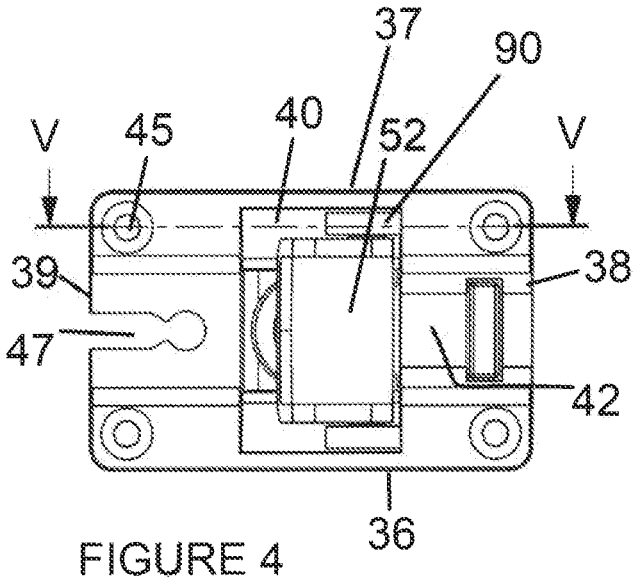
FIG. 4 is a bottom view of the brake assembly of FIG. 3, with the brake member in the fully extended configuration.

The predetermined path provided in the illustrated embodiment will be described further, with particular reference to FIGS. 4, 5 and 15, in due course.

As illustrated in FIGS. 2 and 3, and also FIGS. 3 to 10, the housing 30 comprises first and second side walls 31, 32 which provide a space therebetween for accommodating at least part of the brake member 50.

The housing may be considered as having an axial direction, corresponding to a direction which is, in use directed away from the bearing surface and perpendicular to the direction of relative movement of the braking arrangement and the bearing surface. In the illustrated embodiment, this axial direction corresponds to the direction of elongation of the draw bar.

At a part of the housing which is, in use, distal from the bearing surface, the side walls 31, 32 are connected by a first laterally extending wall 33 which provides a passage 34, through which an actuating part of the brake arrangement can pass. The actuating part may be an elongate stem 56 of a brake member 50, as will be described in due course. The passage 34 allows movement of the actuating part in the axial direction of the brake assembly, and also provides sufficient clearance to allow some change in orientation of the actuating part, as will be described in due course.

At a part of the housing which is, in use, closer to the bearing surface, the side walls 31, 32 are connected by a base portion 35 of the housing 30. The base portion 35 provides first-side and second-side portions 36, 37 and front and rear portions 38, 39, to provide (in the illustrated embodiment) the base portion 35 with an external shape which is substantially rectangular in end view (or transverse cross section).

A region of the base portion 35 which is further from the first laterally extending wall 33 is adapted, in use to provide an end of a draw bar and to engage a guide track of which the bearing surface forms a part.

The base portion 35 provides a passage 40 (see, for example, FIGS. 4 to 6) for allowing brake member 50 to extend therethrough, so that the friction surface 52 can contact the bearing surface.

The rear portion 39 of the base portion 35 includes a laterally central region defining a retaining channel portion 47 for retaining part of the leading edge of a screen material therein.

In the illustrated embodiment, the housing 30 provides an internal wall portion 42 which extends between the side walls 31, 32 and provides a passage 43, between the internal wall portion 42 and the front portion 38 of the base portion 35. The passage 43 extends substantially in the axial direction of the housing 30, and in use, accommodates part of a latch member 110, and guides movement of the latch member 110 substantially in the axial direction of the brake assembly. The latch member 110 is provided to enable the draw bar to be retained by a catch provided on or adjacent the guide track, as will be described in due course.

The side walls 31, 32 are also connected by a rear wall 41 of the housing 30.

The housing 30 also provides at least one connection formation for connection of the link members 90 thereto. In the illustrated embodiment, the least one connection formation comprises a through bore 44, which extends through the internal wall portion 42.

The housing 30 also provides a number of fixing holes 45 which extend through the base portion 35, adjacent the corners of the rectangular cross sectional shape thereof, to facilitate attachment of the brake assembly 20 to one or more other parts of a draw bar.

The brake member 50 provides the brake pad 51, and a brake shoe 53 or holding portion, for holding the brake pad 51. The brake shoe 53 provides a transverse wall portion 53A, and side wall portions 54, 55 which extend along lateral sides of the brake pad 51 to enhance retention of the brake pad by the brake shoe 53.

Extending away from the brake shoe 53, and directed away from the friction surface, there is provided an actuating member via which the brake shoe 53 can be moved. In the illustrated embodiment, the actuating member is in the form of a rod or stem 56, which forms part of the brake member 50. In this embodiment, the stem 56 provides a connection formation, in the illustrated embodiment in the form of an aperture 57, for connection to an operating mechanism, such as a handle, which can be operated to effect withdrawal of the brake pad 51 from the bearing surface. As foreshadowed above, and as can be seen in, for example, FIG. 3, in use the stem 56 extends through the passage 34 in the first laterally extending wall 33, and the aperture 57 is on part of the stem 56 which projects past the first laterally extending wall 33. So that it may be regarded as being external to the housing 30.

The brake member 50, further provides latch member engagement parts 58, 59 which engage the latch member 110 so that withdrawal of the brake pad 51 away from the bearing surface by movement of the brake member 50 also effects movement of the latch member 110. This can allow or assist in disengaging the latch member 110 from a catch provided on or adjacent the guide track, without requiring a different operating mechanism.

The brake member 50 further provides one or more connection formations for connection of the link members 90. In the illustrated embodiment, the connection formations are in the form of stub axles 60, 61, which may be provided projecting laterally outwardly from the side wall portions 54, 55 of the brake shoe 53. In the illustrated embodiment, the one or more connection formations are provided an in use front part of the brake member 50, for example, adjacent front edges of the side wall portions 54, 55 of the brake shoe 53. In the illustrated embodiment the one or more connection formations are substantially coaxial.

In the illustrated embodiment, the brake assembly 20 provides first and second link members 90, 90A, one on either lateral side of the brake assembly 20. It will be appreciated that the form and function of the two link members 90, 90A generally correspond, with the second link member 90A being a mirror image of the first link member 90, so that the form and function if the first link member 90, described below, applies mutatis mutandis to the second link member 90A.

The first link member 90 is in the form of a substantially rigid member that is somewhat elongate and has a first end region 91 and a second end region 92.

The first end region 91 provides a first connection formation 93 for allowing pivotal connection to a connection formation provided on the brake member 50. In this embodiment, the first connection formation 93 is in the form of a recess or aperture for connection to a stub axle 60 provided on the first side wall portion 54 of the brake shoe 53.

The second end region 92 provides a second connection formation 94 for allowing pivotal connection to a connection formation provided on the housing 30. In this embodiment, the second connection formation 94 is in the form of a recess or through aperture for connection to the through bore 44, which extends through the internal wall portion 42 of the housing 30. A pivot axle in the form of a connecting pin 46 is used to connect the second connection formation 94 to the through bore 44, by extending through the second connection formation 94 of the first link member 90 and into the through bore 44. It will be appreciated that in the illustrated embodiment, the connecting pin 46 extends through the second connection formation 94 of the first link member 90, through the through bore 44 of the housing 30, and through a second connection formation 94A of the second link member 90A to connect both the first and second link members 90, 90A to the housing 30. It should also be appreciated that the connecting pin 46 is supported along most of its length by its engagement in the through bore 44 which helps avoid undesirable bending of the connecting pin 46.

The second end region 92 of the first link member 90 is provided with a boss, or spacing formation 95, which engages the housing 30 and spaces the rest of the first link member laterally outwardly relative to the housing 30. This can help avoid the brake shoe 53 interfering with movement of the first link member 90, in use.

In use, the first and second link members 90, 90A remain substantially mutually parallel. Provision of link members 90, 90A on each lateral side of the housing assists in distributing forces laterally across the width of the brake arrangement and in avoiding undesirable torques on the components of the brake arrangement.

Provision of the first and second link members 90, 90A, which each maintain a constant distance between a part of the housing (in the illustrated embodiment, the connection formation, through bore 44) and a part of the brake member (in the illustrated embodiment, the connection formations, stub axles 60, 61) provides a predetermined path of movement for the brake member 50, and particularly for the friction surface 52, relative to the housing.

The predetermined path therefore, in this embodiment, corresponds to a path in which the connection formations 60, 61 of the brake member 50 move in an arcuate path, centred substantially about the connection formations provided on the housing 30, and the connecting pin 46. This predetermined path is arranged and oriented so that a frictional force between the friction surface 52 and the bearing surface can force and/or move the friction surface 50 along part of the predetermined path, towards the bearing surface, thus increasing the braking force, as foreshadowed above.

Figure 5:
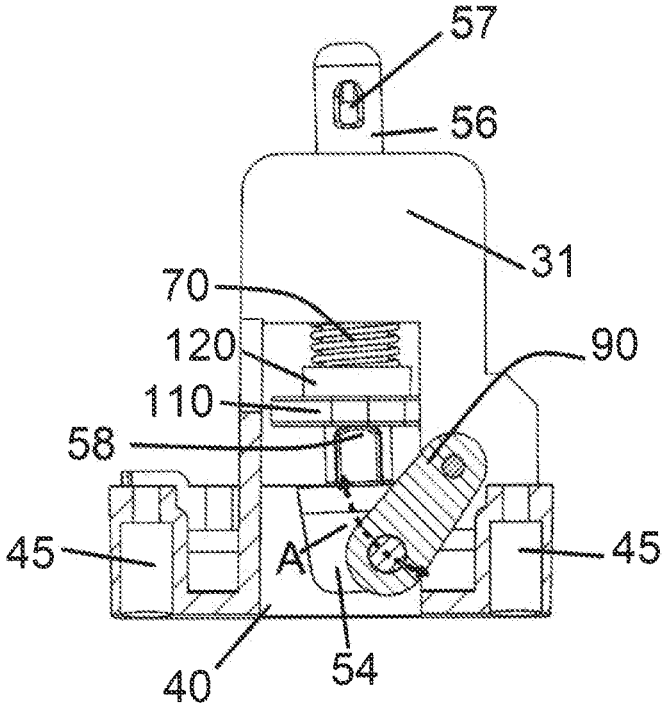
FIG. 5 is a cross sectional view on V-V of FIG. 4, of the brake assembly of FIGS. 3 and 4, with the brake member in the fully extended configuration.

FIG. 5 illustrates the brake assembly 20 with the brake member 50 substantially at its most extended position, that is, at one end of the predetermined path along which it can move.

Figure 6:
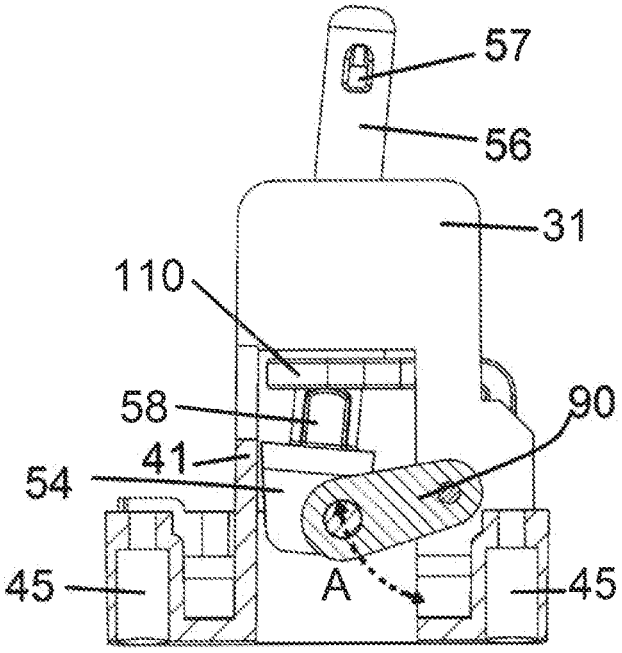
FIG. 6 is a cross sectional view corresponding to the cross sectional view of FIG. 5, but showing the brake member in a withdrawn configuration.
Figure 7:
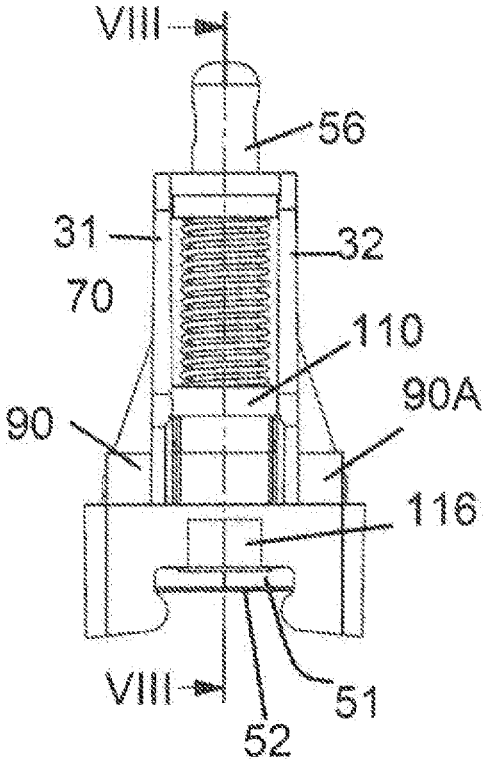
FIG. 7 is a front view of the brake assembly of FIG. 3, with the brake member in the fully extended configuration.

FIG. 6 illustrates the brake assembly 20 with the brake member 50 substantially at its most withdrawn position, that is, at one the other of the predetermined path along which it can move.

FIGS. 5 and 6 provide cross sectional views through the first link member so that the positions of the link member 90 can be clearly seen. FIGS. 5 and 6 further include a broken-line double headed arrow, designated 'A', which illustrates schematically the predetermined path along which the brake member's movement is constrained. For convenience, the arrow A illustrates the path of the axis of the stub axles 60, 61 and can be seen to extend beyond the actual range of movement, since it extends to the right and downwardly beyond the position of the stub axle 60 in FIG. 5. It will be appreciated that the path of the axis of the stub axles corresponds substantially to the arcuate path of the first end of the link member 90, but that the predetermined path of the brake member as a whole is more complex, as there is a rotational degree of freedom between the brake member 50 and the link member 90, and a distal region of the stem 56 of the brake member 50 is constrained to slide through the passage 34, but slightly changes orientation as it does so, as can be seen by comparison of FIGS. 5 and 6. The path of the friction surface 52 (at least the part of the friction surface closest to the axis of the stub axles) approximates the path of the axis of the stub axles, as the axis of the stub axles is close to the friction surface.

Figure 15:
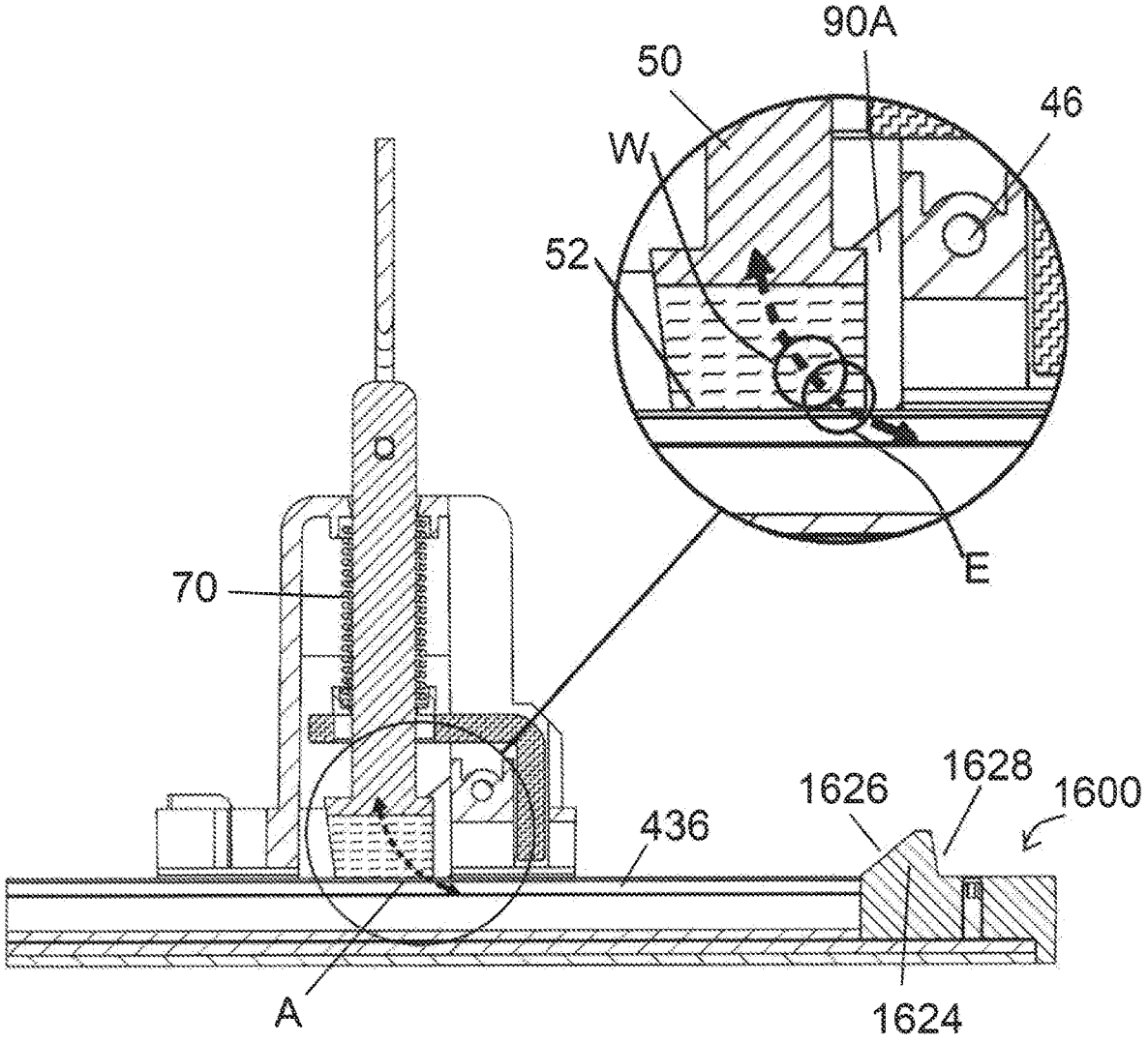
FIG. 15 is cross sectional view on XV-XV in FIG. 13 showing a braking surface of the brake assembly engaging a bearing surface of guide track.

Further, it should be appreciated that, in use, when the friction surface 52 engages a bearing surface the abutment with the bearing surface will generally prevent the brake member 50 from reaching the position illustrated in FIG. 5, but will cause it to be held in a position just offset from this fully extended position (as illustrated in, and described further with reference to, FIG. 15). Frictional forces resulting from engagement of the friction surface with the bearing surface as a result of movement or forcing of the draw bar in the retraction direction of the screen, will force the brake member towards the fully extended position illustrated in FIG. 5, thus forcing the friction surface against the bearing surface and increasing braking force.

As foreshadowed above, in the illustrated embodiment, the brake arrangement includes a latch member 110. The latch member provides a biased actuating part 111 which is engaged, in use by the engagement parts 58, 59 so that an operation (e.g. by a user) which withdraws the brake pad 51 from the bearing surface can also be used to move the latch member in an axial direction of the housing 30 to disengage the latch member from a catch (as will be described in due course). The actuating part 111 also provides an aperture forming a passageway 112 for the stem 56 to pass through. Thus the actuating part 111 may be regarded as both extending around, and being supported by, part or parts of the brake member 50.

The actuating part may be regarded as having a first-side surface 113 which is closer to, and faces generally towards, the friction surface 52, and a second-side surface 114 which is further from, and faces generally away from, the friction surface 52.

The latch member further provides a catch engaging part 115 which depends substantially perpendicular from the actuating part 111. In use, the catch engaging part 115 is located in and guided by the passage 43, described above, and has a terminal region 116 which can extend beyond the passage 43 to engage the catch.

The aperture forming the passageway 112 in the actuating part 111 is elongated in the front-rear direction of the brake assembly and provides a somewhat loose fit for the stem 56, at least in the front-rear direction, allowing the stem 56 some freedom of movement in the front-rear direction despite the actuating part 111 of the catch member being constrained to move substantially in the axial direction of the brake assembly.

In the illustrated embodiment, the brake assembly 20 further includes a moveable seat 120 for retaining the first end 72 of the spring 70. The moveable seat 120 extends around the stem 56 of the brake member 50, the stem extending, in use, through a passageway 121 in the moveable seat 120. The moveable seat has a first side 122 which faces towards, and is shaped to retain, the first end 72 of the spring 70. The moveable seat has a second side 123 which engages the second-side surface 114 of the actuating part 111 of the latch member 110.

In use, the moveable seat 120 is forced against the second-side surface 114 of the actuating part 111, but can slide relative thereto, so that it can move relative to the latch member 110, with the stem 56, in the front-rear direction, while retaining engagement with the first end 72 of the spring 70. This assists consistent application of the bias force by the spring 70 to the brake member 50 (and the latch member 110) irrespective of the position and orientation of the brake member relative to the housing 30. By way of illustration, FIG. 8 shows the moveable seat 120 positioned further towards the front of the brake assembly 20 (corresponding to a more extended position of the brake member 50) and FIG. 10 shows the moveable seat 120 positioned further towards the rear of the brake assembly 20 (corresponding to a more withdrawn position of the brake member 50).

Figure 8:
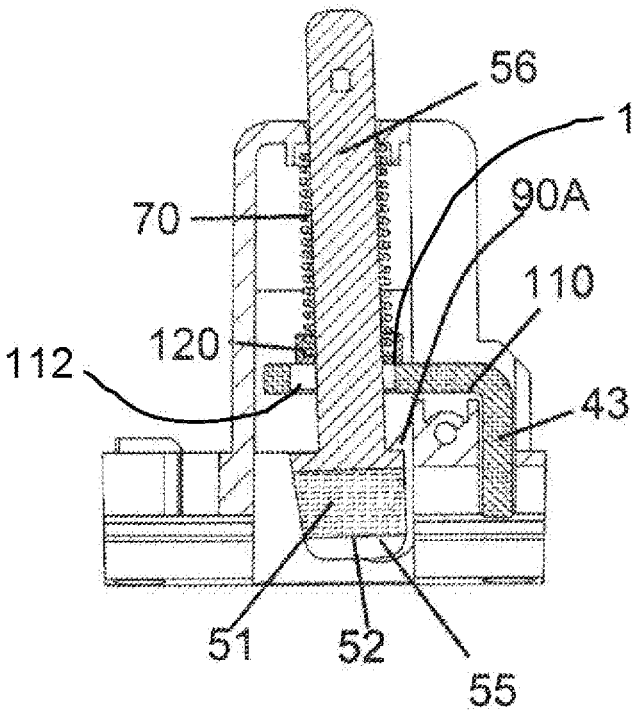
FIG. 8 is a cross sectional view on VIII-VIII of FIG. 7.
Figure 9:
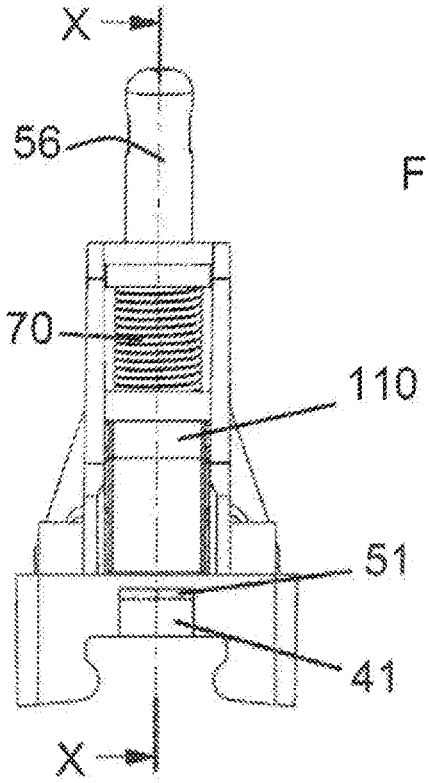
FIG. 9 is a front view of the brake assembly of FIG. 3, with the brake member in a withdrawn configuration.
Figure 10:
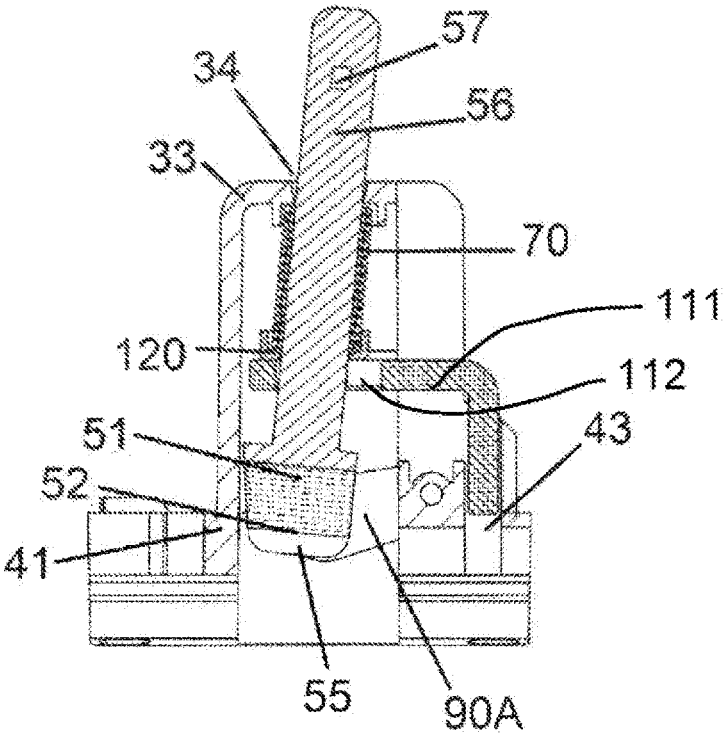
FIG. 10 is a cross sectional view on X-X of FIG. 9.

FIGS. 8 and 10, also illustrate effectively that the side wall portions 54, 55 of the brake shoe 53 extend beyond the friction surface 52 in the axial direction of the brake assembly 20.

Figure 11A:
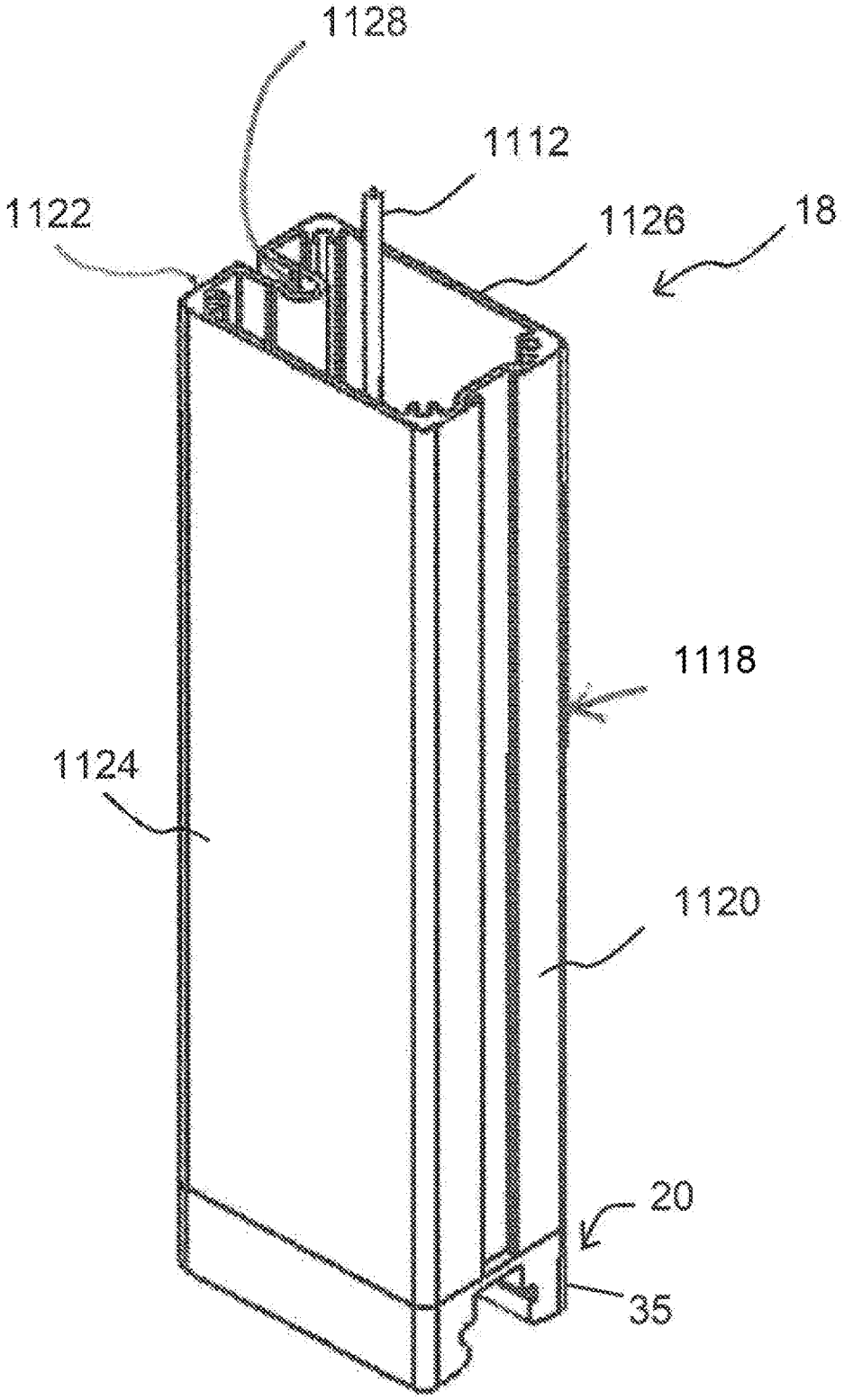
FIG. 11(*a*) is a perspective view of a bottom region of a draw bar of the type used in the screen assembly of FIG. 1, showing the brake assembly incorporated into the bottom of the draw bar, by attachment at the bottom of a draw bar main body.
Figure 11B:
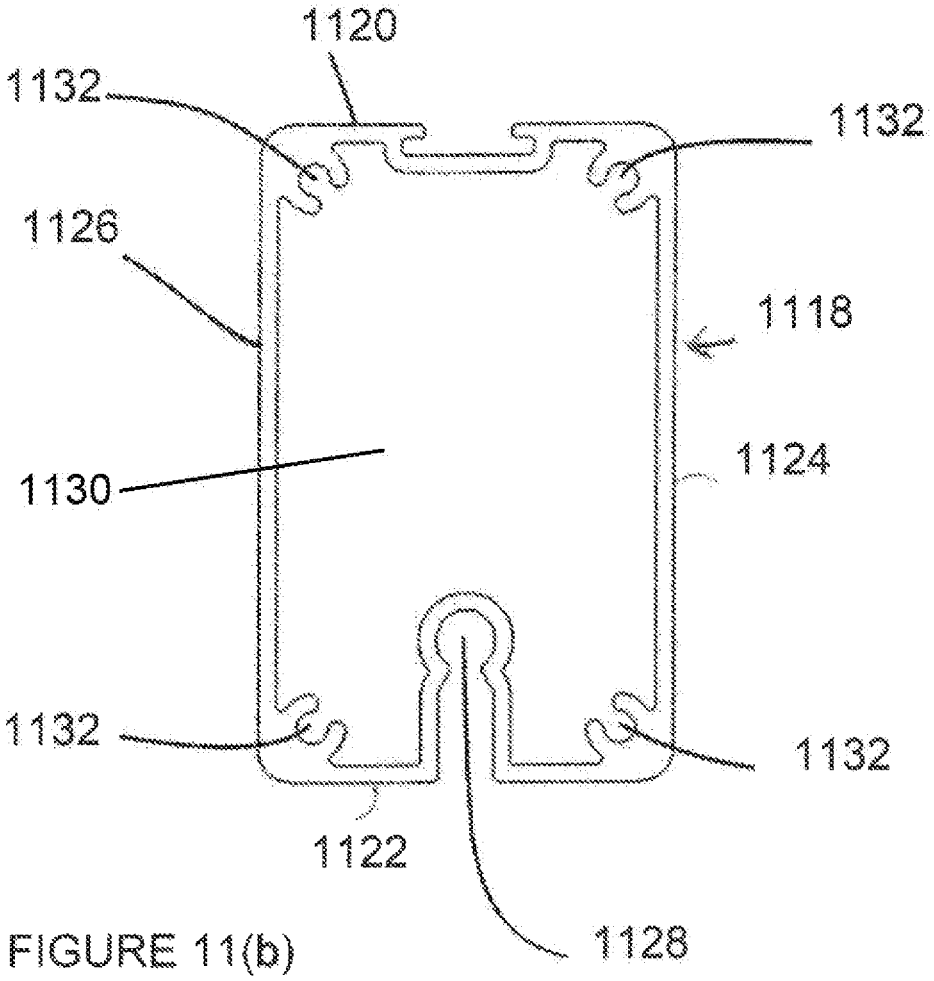
Figure 11C:
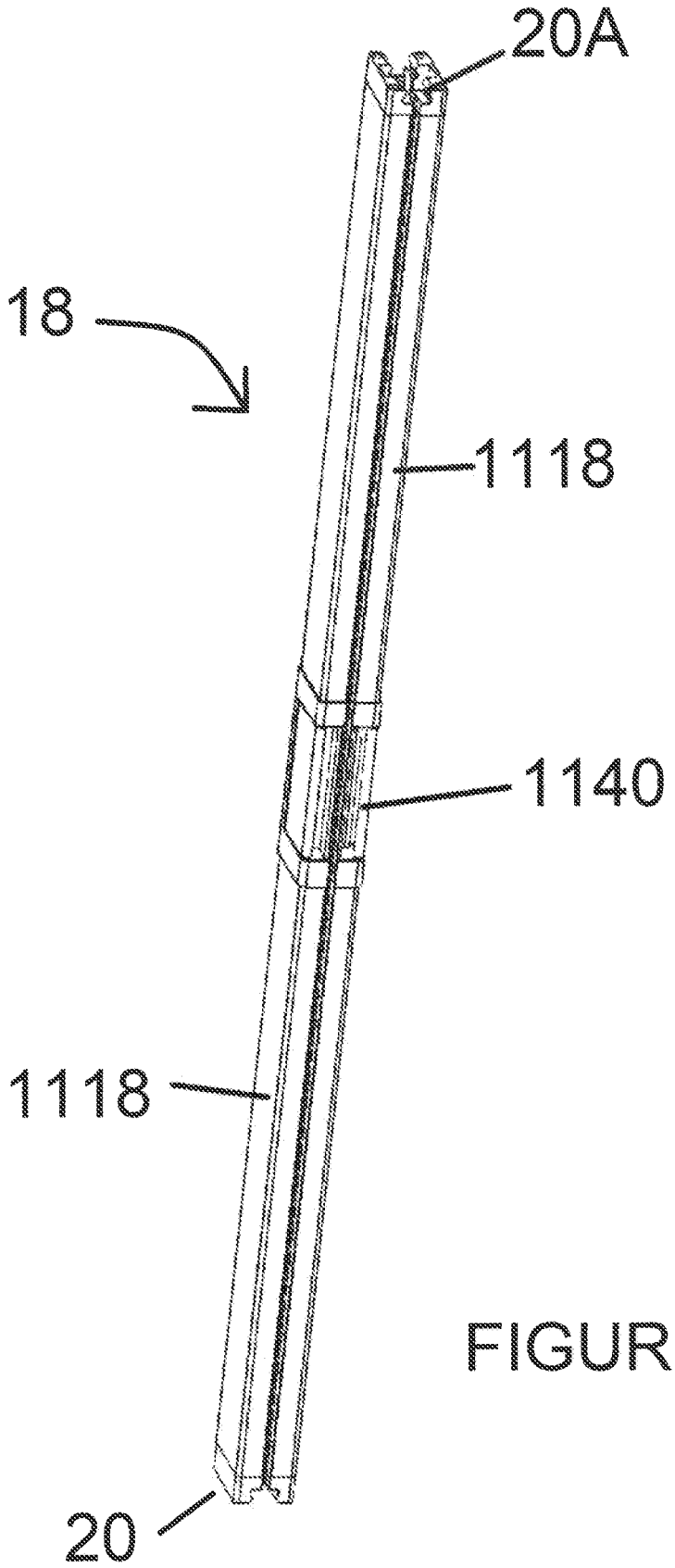

FIG. 11(*a*) is a perspective view of a bottom region of a draw bar, for example, the draw bar 18 of FIG. 1, showing the brake assembly 20 incorporated into the bottom of the draw bar 18, by attachment at the bottom of a draw bar main body 1118 (of which only the bottom region is shown in FIG. 11(*a*)). It will be appreciated that the draw bar main body 1118 is hollow, and that most of the brake assembly 20 is accommodated within an interior of the draw bar main body so that only part of the base portion 35 of the brake assembly 20 is visible in FIG. 11(*a*).

FIG. 11(*a*) also shows a withdrawal member 1112, which may be, for example, a rod, cable or wire. The withdrawal member 1112 extends along the hollow interior and is attached to the connection formation, aperture 57, of the brake member 50 at one (e.g. a lower) end thereof, and to an operating mechanism, such as a handle, at the other (e.g. a higher) end thereof, to connect the operating mechanism to the brake member 50. This allows operation of the operating mechanism (not shown) by a user to effect withdrawal of the brake pad 51 from the bearing surface.

FIG. 11(*b*) is a schematic transverse cross sectional view of the draw bar main body 1118.

The draw bar main body 1118 may be regarded as having a front side wall 1120 which, in use, is distal from a roller onto which the screen material can be wound and unwound, so that it provides a 'front' or leading wall of the draw bar when the draw bar is being moved to extend (close) the screen. The draw bar main body 1118 may further be regarded as having a rear side wall 1122 opposed to the front side wall 1120. The draw bar main body 1118 further has first and second lateral side walls 1124, 1126 of the draw bar main body 1118.

A formation defining a retaining channel 1128 is provided in the rear side wall 1122. The retaining channel 1128 is for retaining a leading edge of the material providing the flexible screen (e.g. flexible screen 12, as shown in FIG. 1).

The retaining channel 1128 is provided substantially laterally centrally in relation to the draw bar main body 1118, and is also provided substantially laterally centrally in relation to the draw bar 18 as a whole. Further, in use, the retaining channel 1128 aligns with, and is substantially continuous with, the retaining channel portion 47 of the base portion 35 of the housing 30.

The draw bar main body 1118 is generally rectangular in transverse cross sectional shape (as shown best in FIG. 11(*b*)) and provides an interior cavity 1130, which is also generally rectangular in transverse cross sectional shape.

As best shown in FIG. 11(*b*), at each corner region, that is, in each region where a lateral side wall 1124, 1126 meets the front side wall 1120 or the rear side wall 1122, the draw bar main body 1118 provides a fixing retaining formation 1132, adapted to facilitate attachment of the brake arrangement 20 to the draw bar main body 1118 by aligning with, and retain a fixing that passes through, a corresponding fixing hole 45 which extends through the base portion 35.

The main body part 1118 may be formed by extrusion, for example, of an aluminium or some other suitable metal or alloy. Alternatively, some other material, such as a suitable plastic, could be used.

The generally rectangular shape of the base portion 35 of the housing 30 of the brake assembly 20 allows the brake assembly 20 to fit to the hollow draw bar main body 1118 to provide a generally continuous external shape, as shown, for example, in FIG. 11(*a*). The transverse cross sectional dimensions of the parts of the brake assembly 20 other than the base region are equal to or smaller than the transverse cross sectional dimensions of the interior cavity 1130 of the draw bar main body 1118, allowing these parts to be accommodated within the hollow interior of the draw bar main body 1118.

FIG. 11(*c*) is a schematic perspective view of a draw bar 18 in isolation, noting that identical brake assemblies 20, 20A may be provided at the bottom and top of the draw bar 18. The brake assemblies 20, 20A may be regarded as being in the form of, or incorporated into, end caps of the draw bar 18.

The draw bar 18 includes an operating mechanism, such as a handle arrangement 1140 which can be used to withdraw the brake member 50, against the bias force of the spring 70, to disengage the friction surface 52 from the bearing surface. As foreshadowed above, in an embodiment, the operating mechanism is connected to the brake member 50 via withdrawal member 1112, which may be, for example, a rod, cable or wire, attached at one end region to the operating mechanism and at the other end region to the brake member 50.

The handle arrangement 1140 may be at an axially (for example, in use vertically) generally central part of the draw bar and a main body element, for example, corresponding to the main body part 1118 may be provided on each side (for example, in use above and below) the handle arrangement 1140.

Any desired and appropriate the operating mechanism may be used. It is convenient to provide an operating mechanism which can disengage brake arrangements at both ends of the draw bar by a single action of a user. Two earlier patent publications describe examples of respective alternative brake release mechanisms which could be used, although of course other brake release mechanisms could be used if desired.

Australian Patent Application No. 2010241510A1, the entire disclosure of which is incorporated herein by reference, describes a brake release mechanism using a handle which can be rotated about an axis substantially perpendicular to the direction of elongation of the draw bar. See especially FIG. 7 of Australian Patent Application No. 2010241510A1, and the corresponding description.

The present applicant's earlier application, Australian Patent Application No. 2017268654, the entire disclosure of which is incorporated herein by reference, describes a brake release mechanism using a handle which can be rotated about an axis substantially parallel to the direction of elongation of the draw bar.

It will be appreciated that both of these brake release mechanisms allow release of the brake arrangements at both ends of the draw bar by a single action of a user. Further, both allow release of the brake arrangements from either lateral side of the draw bar.

Figure 12:
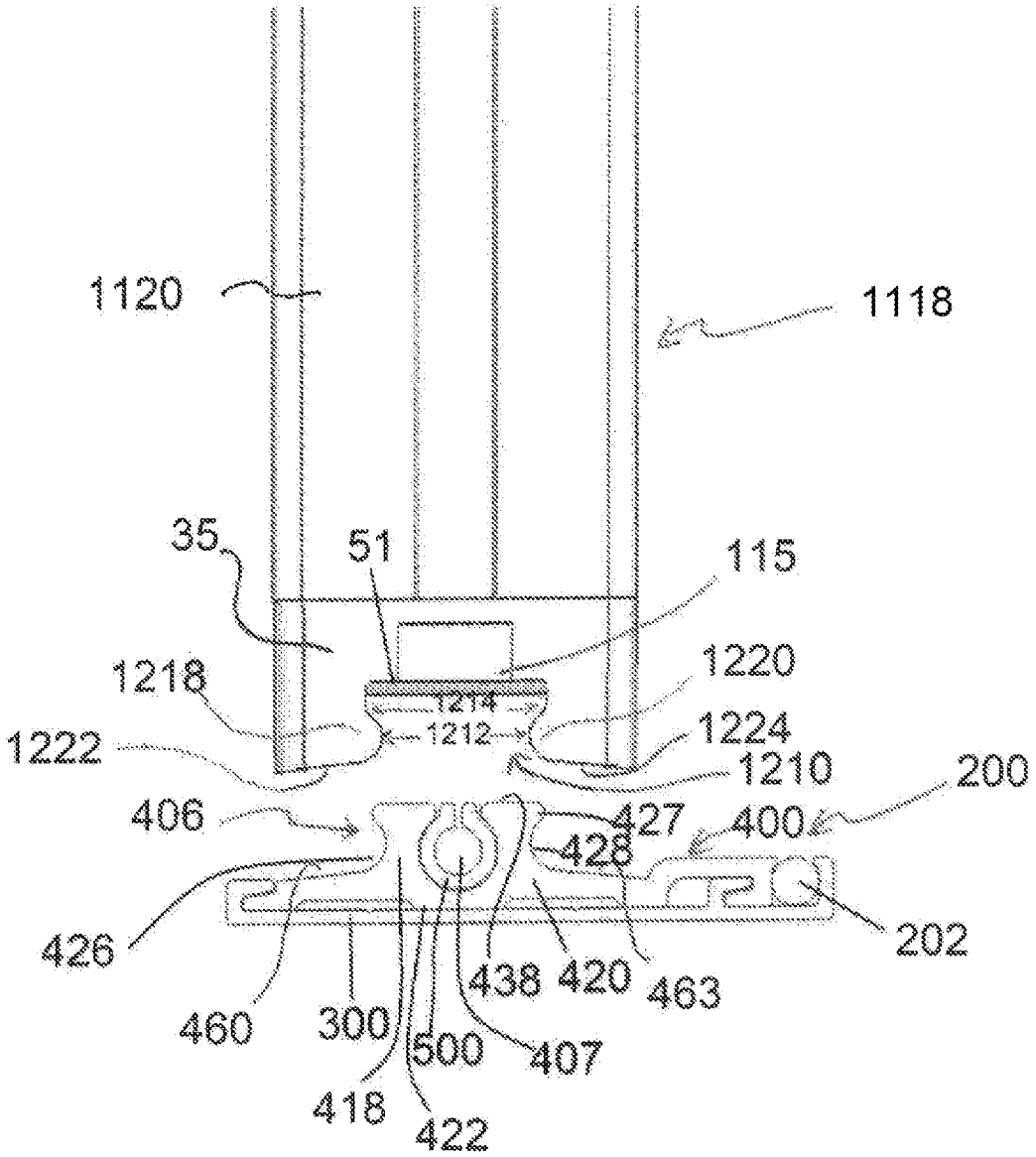
FIG. 12 illustrates, in front view, the bottom region of a draw bar in proximity to a guide track, and shows the complementary shapes of connecting parts of the draw bar and guide track.

FIG. 12 provides an enlarged front view of the bottom-most region of the draw bar 18, adjacent an example of a bottom track which may retain and guide the draw bar 18 in use, and which may provide the bearing surface for engagement by the friction surface 52.

As shown in FIG. 12, the base region 35 of the brake assembly 20 provides an engaging formation shaped to operatively engage a track element 400 of a guide track arrangement, generally designated 200. In the illustrated embodiment, the engaging formation provides a shaped cavity 1210 substantially at the end of the draw bar 18.

In the embodiment illustrated in FIG. 12, the guide track arrangement 200, comprises the track element 400 and a separately formed elongate mounting element 300 to which the track element 400 is attached. The track element 400 is retained relative to the elongate mounting element 300 by a securing strip 202.

The track element 400 provides a track portion 406 which provides an elongate guide cavity 407 for receiving an edge of a flexible screen. A guide cavity insert in the form of a track runner 500 is retained within the elongate guide cavity 407 to assist in retaining and guiding an edge of the screen.

The track portion 406, in this embodiment, may be regarded as having first and second track regions 418, 420 which are laterally adjacent but slightly spaced apart and shaped to define the elongate guide cavity 407 therebetween.

The first and second track regions 418, 420 are both connected to a base region 422 of the track portion 406. The base region 422 provides a base surface portion for engagement with the elongate mounting element 300.

Each of the first and second track regions 418, 420 has a laterally outwardly facing surface 426, 428, respectively, which faces generally laterally outwardly towards a lateral edge of the elongate track element 400. In the illustrated embodiment, the laterally outwardly facing surfaces 426, 428 are concave, so that the track portion 406 (formed by the first and second track regions 418, 420) is laterally wider closer to and further from the base region 422, and laterally narrower at an intermediate distance from the base region 422. Thus, the track portion 406 may be regarded as having an 'hourglass' shape, and/or an outwardly tapering terminal part 427 distal from the base region 422.

Each of the first and second track regions 418, 420 has a terminal surface 436, 438, respectively. The terminal surfaces 436, 438 correspond to the parts of the first and second track regions 418, 420 which are distal from the base region 422.

The terminal surfaces 436, 438 of the track portion 406 together provide the bearing surface which is, in use, engaged by the friction surface 52. It will be appreciated that the terminal surfaces 436, 438, are substantially planar in form, and that the bearing surface, may also be regarded as being generally planar in form.

The guide track arrangement 200 illustrated in FIG. 12 is disclosed in greater detail in the present applicant's earlier Australian Patent Application No. 2017268647, the entire disclosure of which is hereby incorporated herein by reference.

The bottom cavity 1210 is shaped to be complementary to the shape of the track, or guide rail, portion 406 as described above. That is, the bottom cavity 1210 provides a narrower lower region 1212 (which is slightly wider than the narrowest region of the track portion 406 to allow the draw bar to slide, but narrower than the terminal part of the track portion 406), and a wider upper region 1214 (which is slightly wider than the terminal part of the track portion 406).

The lower narrower lower region 1212 of the bottom cavity 1210 may be regarded as being defined by first and second lower side portions 1218, 1220 of the base region 35 which are spaced apart such that they define a width of the narrower lower region 1212 of the bottom cavity 1210 which is slightly wider than the narrowest region of the track portion 406, but narrower than the terminal part 427 of the track portion 406. In this embodiment, the bottom cavity 1210 is substantially at the lateral centre of the draw bar 18, and of the brake assembly 20. First- and second-side bottom surfaces 1222, 1224 of the draw bar 1200 engage respective upwardly facing surfaces 460, 463 of the elongate track element 400, to at least partially support the draw bar on the elongate track element 400. It is to be understood that the draw bar 18 would also, in use, be supported at its other end (for example, its top) by a similar engagement arrangement (or, if desired, by any other desired and suitable engagement arrangement).

FIGS. 13 to 19 illustrate use and/or operation of the brake assembly 20 in conjunction with elongate track element 400. The draw bar main body 1118, and the flexible material forming the screen 12, are omitted from these drawings for clarity.

Figure 13:
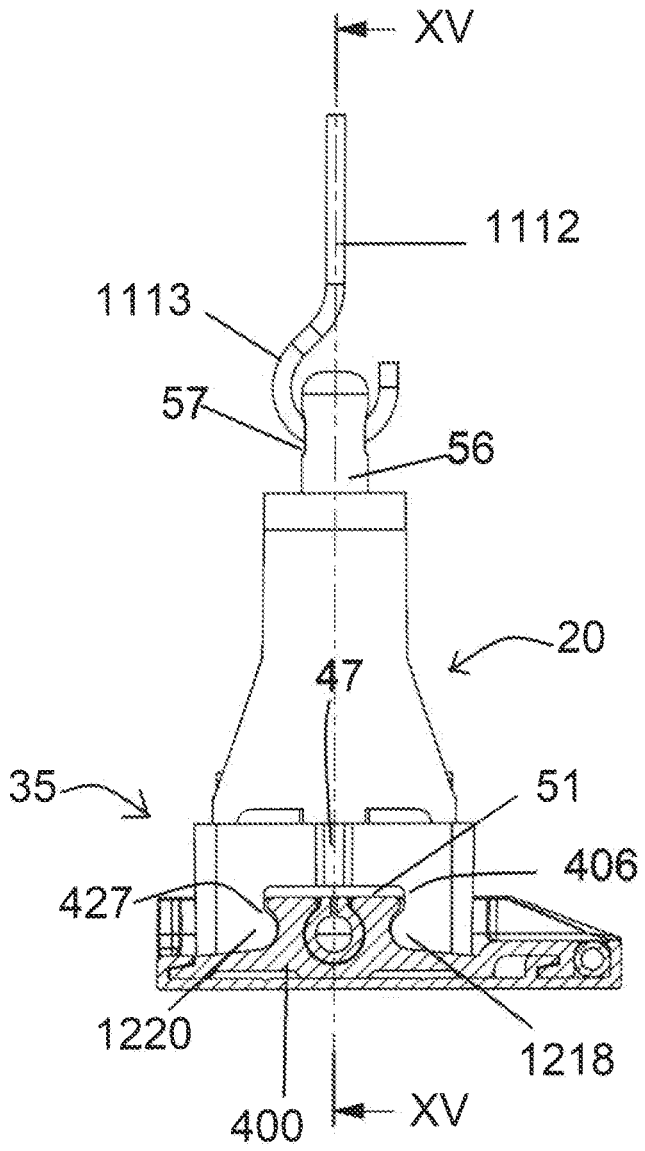
FIG. 13 is a rear view of a brake assembly in use with a guide track.

FIG. 13 is a view, from the rear, of the brake assembly 20 engaged on and with the elongate track element 400, which is shown in transverse cross section.

The outwardly tapering terminal part 427 of the track portion 406 may be regarded as being retained within the bottom cavity 1210 of the brake assembly 20. Alternatively, the first and second lower side portions 1218, 1220 of the base region 35 (which define the width of the narrower lower region 1212 of the bottom cavity 1210) may be regarded as being trapped under, and retained by, the tapering terminal part 427 of the track portion 406. As shown in FIG. 13, the brake pad 51 is in contact with the bearing surface provided by terminal surface 436, 438, of the track portion 406.

The withdrawal member 1112 is connected to the brake member 50 by engagement of a connecting portion 1113 of the withdrawal member 1112 with or through the connection formation (aperture 57) of the stem 56. In the configuration shown in FIG. 13, no substantial force is applied to the brake member 50 by the withdrawal member 1112, and the friction surface 52 of the brake pad 51 is maintained in contact with the bearing surface (terminal surfaces 436, 438) by the bias force applied by the spring 70 (not shown in FIG. 13).

Because the guide channel provided by the elongate guide cavity 407 is provided substantially at the lateral centre of the guide rail (provided by the track portion 406), the connection of the screen material to the draw bar 18 may easily be configured so it is spaced equidistant to each side of the guide rail, and equidistant to each side of the draw bar 18.

Thus the retaining channel 1128 in the draw bar 18 is in use aligned with the retaining channel portion 47 (visible in FIG. 13), which is provided substantially laterally centrally in relation to the bottom cavity 1210 of the brake assembly 20, and in relation to the brake assembly as a whole. Having the retaining channel 1128, and retaining channel portion 47, substantially aligned with the opening of the guide cavity 407, which retains the bottom edge of the screen material, allows the extension of the screen material from the draw bar 18 into the guide cavity 407 to be aligned with the lateral centre of the draw bar. Such an arrangement is aesthetically pleasing in its symmetry and can avoid substantial torque on the draw bar and its engagement with the guide rail being imparted by a retraction force applied to the draw bar by the screen, or by a short period of higher than normal friction between the screen edge and the interior of the guide channel. This can assist smooth running of the draw bar on the guide rail as it slides therealong, for example, between an open position towards the roller onto which the screen material can be wound and unwound and a closed position further away from the roller.

Figure 14:
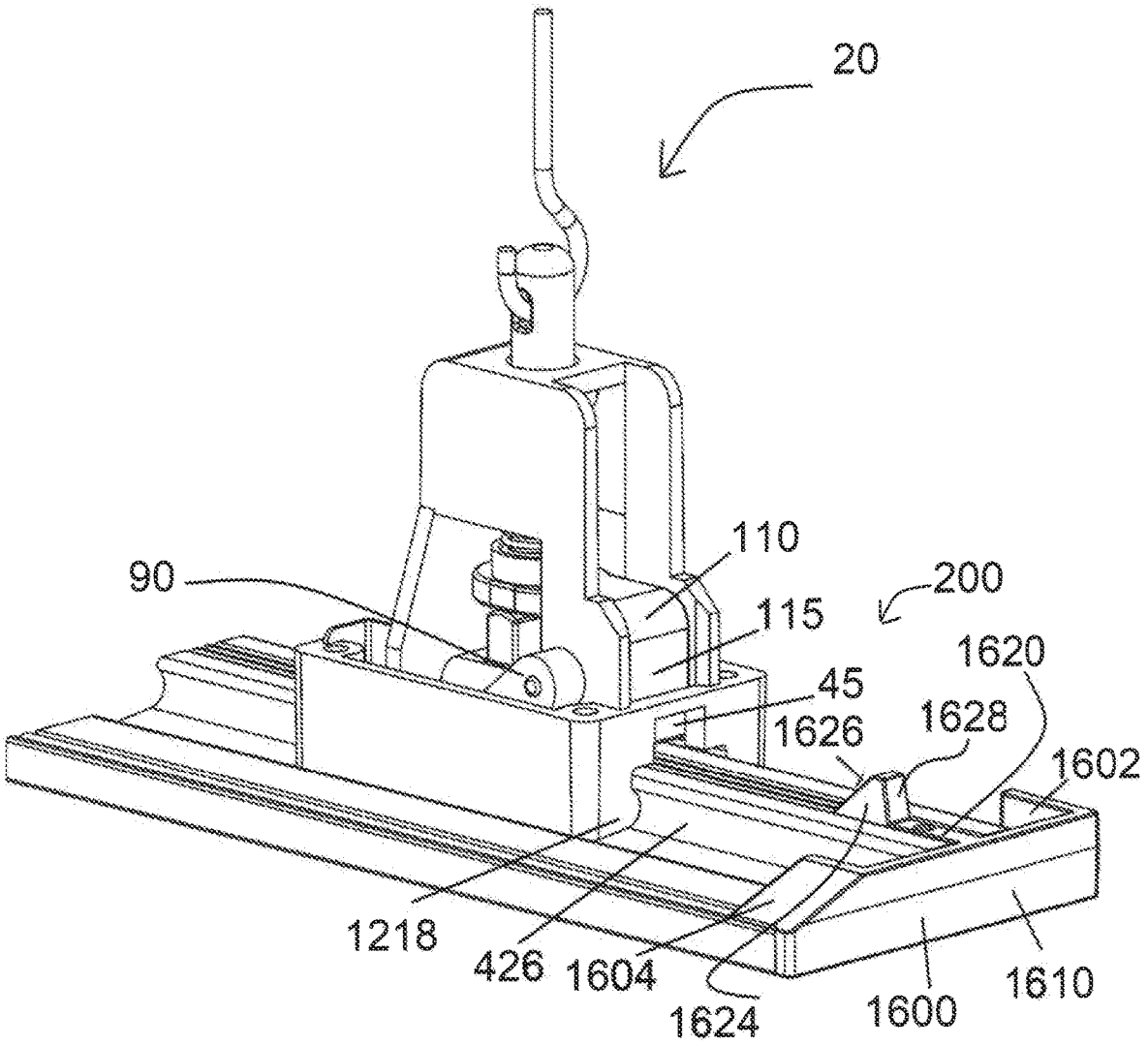
FIG. 14 is front perspective view corresponding to FIG. 13.

FIG. 14 is front perspective view of the brake assembly 20 corresponding to FIG. 13.

As shown in FIG. 14, the guide track arrangement 200 is provided with an end piece 1600, which provides a catch portion 1624 for interaction with the latch member 110. The end piece 1600 comprises an end panel 1610 adapted to abut an axial end of the guide track arrangement 200, a first-side member 1602 adapted to align with a first lateral side of the guide track arrangement 200 and a second-side member 1604 adapted to align with a second lateral side of the guide track arrangement 200.

The end cap 1600 further comprises a cavity projection 1620 which projects perpendicular to the end panel 1610 and which is adapted to project a short distance into an end region of the guide cavity 407 that has been left without any of the track runner 500 provided therein. The cavity projection 1620 is sized and shaped to fit closely to the interior walls of the guide cavity 407.

A catch portion 1624 projects from the cavity projection 1620 and, in use, projects outwardly to provide a catch formation for engagement by, and retention of, the latch member 110. This can assist in retaining the draw bar in a position corresponding to the fully extended (closed) position of the screen. The catch portion 1624 provides a ramp portion 1626 on a side which in use faces towards the roller of the screen, to enable the latch member 110 to ride over the catch portion 1624 merely by movement of the draw bar 18, and an abutment portion 1628 on a side which in use faces away from the roller of the screen, to provide capture of the latch member 110, unless it is deliberately released. This can allow the latch member 110 to be engaged automatically upon full extension of the screen, but to require deliberate and/or manual release in order to allow movement of the draw bar from that position in the retraction direction of the screen, as will be described further in due course. Further detail of the end piece 1600 is provided in the present applicant's earlier Australian Patent Application No. 2017268647, incorporated herein by reference.

FIG. 15 is cross sectional view on XV-XV in FIG. 13, also corresponding to the configuration, or state, of the brake assembly 20, as shown in FIG. 14. The configuration, or state, of the brake assembly 20, as shown in FIGS. 13 to 15 may be regarded as the state when the draw bar 18 is stationary and the brake apparatus 20 is resisting movement of the draw bar 18 in the retraction direction of the screen (referred to herein as the rear or rearwards direction in relation to the draw bar).

As illustrated, the friction surface 52 of the brake pad 51 is maintained in contact with the bearing surface (terminal surfaces 436, 438) by the bias force applied by the spring 70.

The same broken-line double headed arrow, designated 'A', has been added in FIG. 15 as is shown in FIGS. 5 and 6, and is to the same scale to the brake arrangement. The arrow a illustrates the arcuate path of the axis of the stub axles 60, 61, as defined by the link members 90, 90A (even though the stub axles 60, 61 are not visible in the laterally central cross sectional view of FIG. 15).

It should appreciated that, as illustrated in FIG. 15, the engagement of the bearing surface by the friction surface 52 prevents the brake member 50 from reaching the position (referred to as the 'fully extended position') illustrated in FIG. 5, but causes the brake member 50 to be held in a position just offset from this fully extended position.

FIG. 15 includes an enlargement of the region where the friction surface 52 engages the bearing surface, and to illustrate the difference in position between the 'working' (FIG. 15) position of the brake member and the fully extended (FIG. 5) position of the brake member 50 circles illustrating the positions of the stub axles have been added to the enlargement. The circle designated 'W' illustrates the position of the stub axles 60, 61 in the 'working' (FIG. 15) position, and the circle designated 'E' illustrates the position of the stub axles 60, 61 in the 'fully extended' (FIG. 5) position.

Frictional forces between the friction surface 52 and the bearing surface which result from movement or forcing of the draw bar 18 in the retraction direction of the screen (i.e. to the left in FIG. 15), will force the brake member 50 to the right as illustrated in FIG. 15, relative to the housing 30. However, the path of the brake member 50 is constrained by the link members 90, 90A so that it cannot move linearly in the front-rear direction of the brake assembly. That is, the brake member 50 cannot move directly to the right, relative to the housing 30. Rather, forcing the brake member to the right relative to the housing causes movement (or forcing) of the brake member in a direction which has a direction component towards the bearing surface thus forcing the friction surface 52 against the bearing surface and increasing braking force. More specifically, with reference to FIG. 15, forcing the brake member 50 to the right, relative to the housing 30, forces the brake member 50 towards the fully extended position.

Thus it will be appreciated that the described embodiment, as illustrated in FIG. 15, in addition to the braking force provided by the engagement of the friction surface with the bearing surface which results from the bias force applied by the spring 70, provides a force-increasing arrangement for increasing the force with which the friction surface engages the bearing surface. Further, the force-increasing arrangement converts at least some of a frictional force applied between the friction surface and the bearing surface into additional contact pressure force applied to the brake member to increase contact pressure between the friction surface and the bearing surface.

Figure 19:
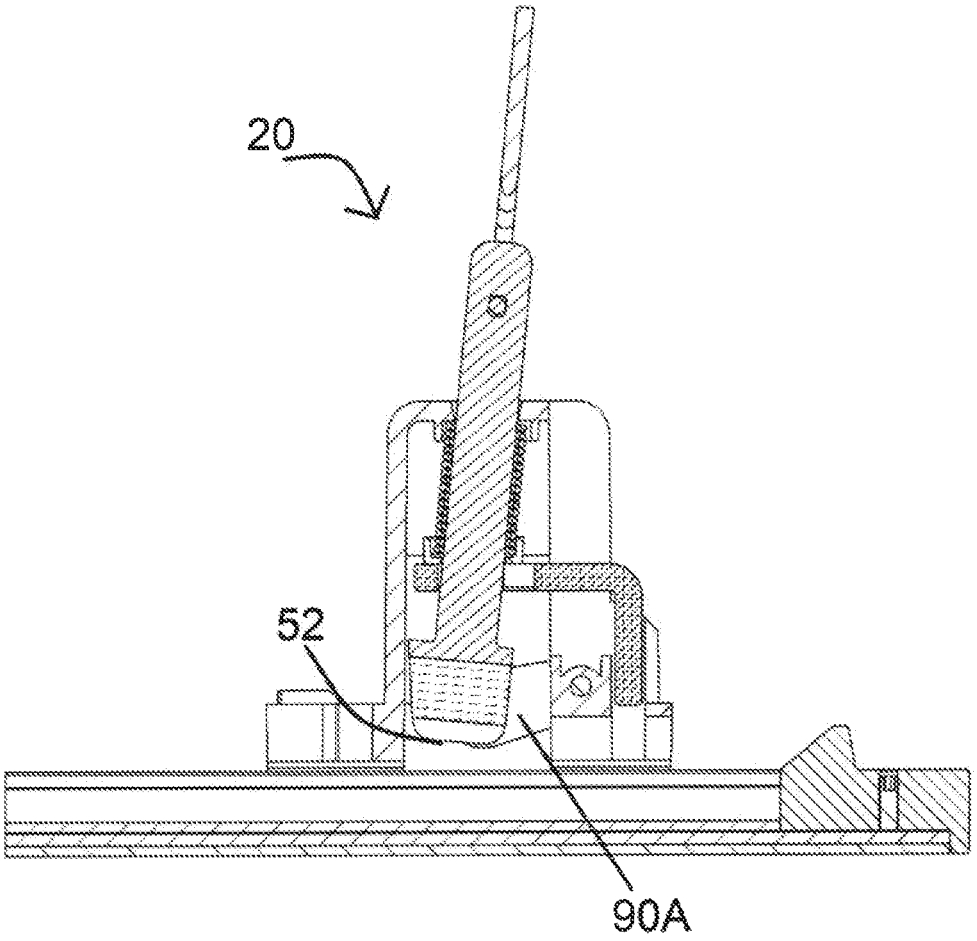
FIG. 19 is a cross sectional view of the apparatus of FIGS. 13 to 17, on the same plane as the FIG. 17 cross sectional view, illustrating movement of the brake assembly, in the retraction direction of the screen, away from the catch.

The additional force applied to the brake member may easily be released, either by moving the draw bar in the extension direction (to the right as illustrated in FIG. 15) or by operating a brake release mechanism (such as a handle) to compress the spring 70 and withdraw the brake member 50, as illustrated, for example, in FIGS. 6 and 19.

Further, it will be appreciated that a frictional force between the friction surface 52 and the bearing surface which results from forcing or movement of the draw bar in the extension direction of the screen will not result in additional contact pressure force applied to the brake member 50, nor increase contact pressure between the friction surface and the bearing surface. Thus the described embodiment allows a strong braking force to be applied to counteract inadvertent or undesired retraction of the screen due to the bias force applied by the roller, but provides substantially less braking force when the screen is being closed. This can allow the screen to be manually closed, by movement of the draw bar in the screen extending direction, with ease, and if desired without operation of a brake release mechanism (handle).

Figure 16:
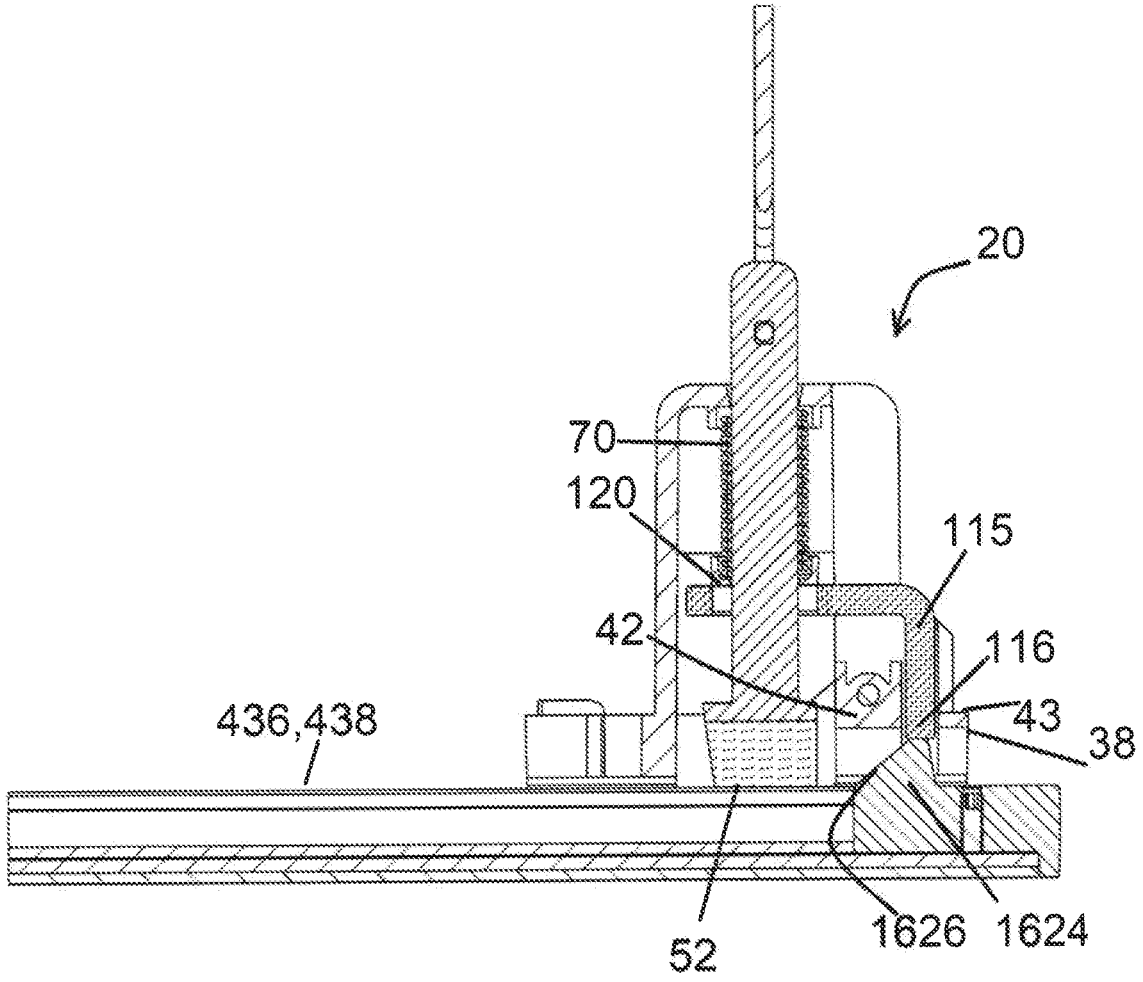
FIG. 16 is a cross section view of the apparatus of FIGS. 13 to 15, on the same plane as the FIG. 15 cross sectional view, illustrating a latch part of the brake assembly riding onto a catch part of the guide track.
Figure 17:
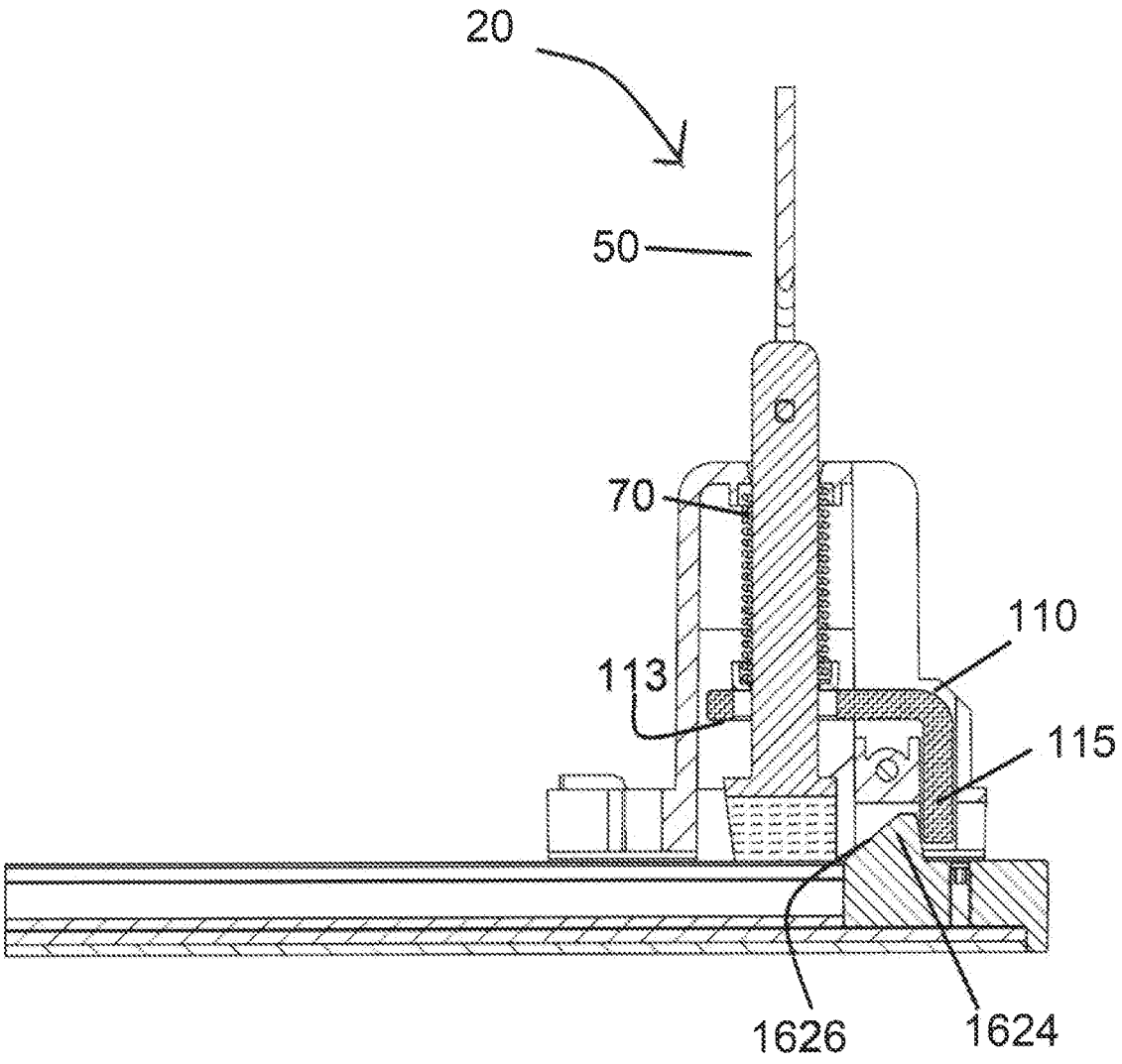
FIG. 17 is a cross section view of the apparatus of FIGS. 13 to 16, on the same plane as the FIG. 16 cross sectional view, illustrating the latch part constrained by the catch part.
Figure 18:
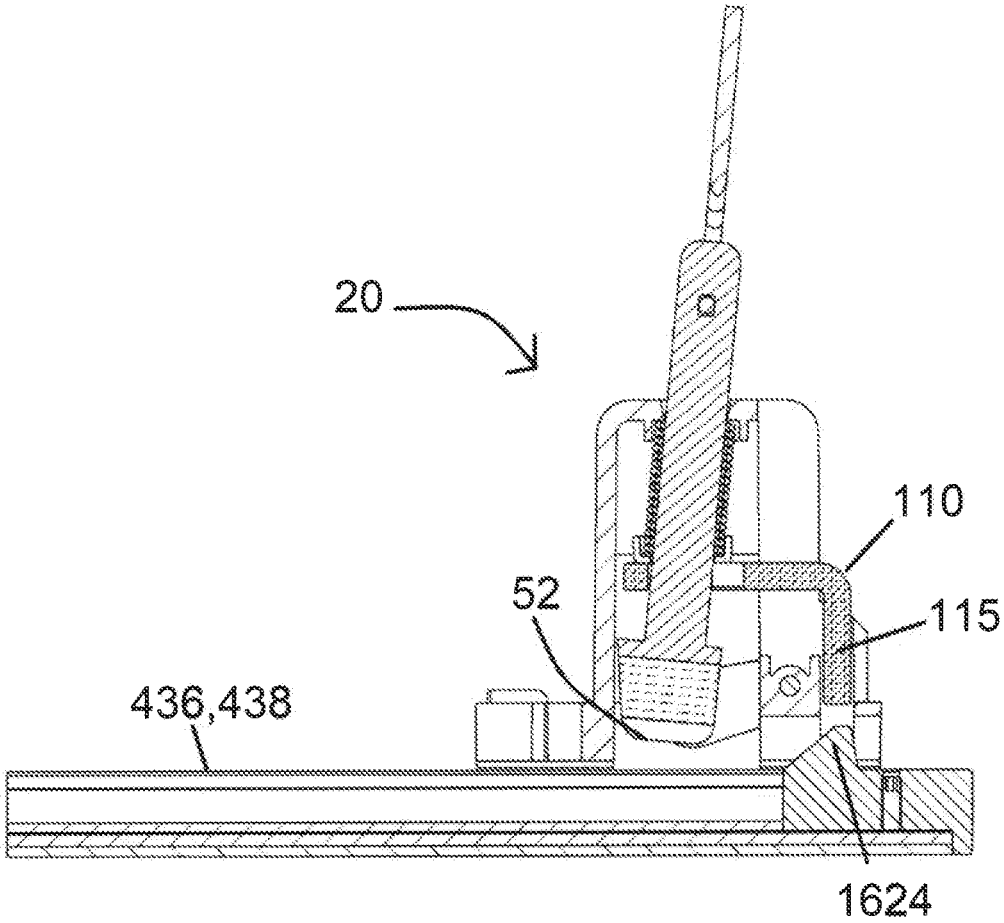
FIG. 18 is a cross section view of the apparatus of FIGS. 13 to 17, on the same plane as the FIG. 17 cross sectional view, illustrating the release of the latch part from the catch by the same action that withdraws the braking surface from the bearing surface.

FIGS. 16 to 18 illustrate operation of the latch member 110.

FIG. 16 is a cross section view of the apparatus of FIGS. 13 to 15, on the same plane as the FIG. 15 cross sectional view, illustrating the latch member 110 of the brake assembly 20 riding up the ramp portion 1626 of the catch portion 1624, as the draw bar 18 is moved to a fully closed position of the screen. Engagement of the terminal region 116 of the catch engaging part 115 of the latch member 110 with the ramp portion 1626 causes the latch member to move substantially in the axial direction of the brake assembly 20, guided by the passage 43, provided between the internal wall portion 42 and the front portion 38 of the base portion 35. This causes a corresponding movement of the moveable seat 120, compressing the spring 70, but does not necessarily disengage the friction surface 52 from the bearing surface 436, 438. It will be appreciated that apart from moving the draw bar into the full closed position of the screen, no specific action (such as operation of a handle) is required by a user in order to engage the latch mechanism.

FIG. 17 illustrates the brake assembly 20 when the draw bar has moved slightly further to fully closed position of the screen than in FIG. 16. The latch member 110 has moved past the ramp portion 1626 and has been forced substantially back to its normal position, first-side surface 113 of the actuating part 111 of the latch member is biased against the engagement parts 58, 59 (not shown in FIG. 17) of the brake member 50 by the spring 70. The catch engaging part 115 of the latch member 110 is constrained by the catch portion 1624, preventing movement of the draw bar 18 in the retraction direction of the screen until the latch mechanism is released.

FIG. 18 illustrates release of the latch member 110 from the catch portion 1624. This can be effected by operation of a brake release mechanism (handle), that is, by the same action that is used to withdraw the friction surface 52 from the bearing surface. When the brake member 50 is withdrawn, the engagement parts 58, 59 force the latch member in the second axial (withdrawal) direction of the brake assembly, thus allowing disengagement of the catch engaging part 115 from the catch portion 1624. Thus when the latch member 110 is operated to release the latch mechanism and allow movement of the draw bar 18 in the retraction direction of the screen, the friction surface is also withdrawn from the bearing surface, as required to facilitate movement of the draw bar 18 in the retraction direction.

FIG. 19 is a cross section view of the apparatus of FIGS. 13 to 17, on the same plane as the FIG. 17 cross sectional view, illustrating movement of the brake assembly, in the retraction direction of the screen, away from the catch, with the friction surface 52 withdrawn from the bearing surface, by operation of the handle by a user. The draw bar may be moved, to in the retraction direction of the screen, to any desired position, for example, to the fully open position of the screen, or to any desired partially open position of the screen, by a user moving the draw bar using the handle (or while the handle is operated to maintain a withdrawn position of the brake member. If the handle is released, the bias force applied by the spring 70 will force the brake member in substantially the first axial direction of the brake assembly, so that the friction surface engages the bearing surface, putting the brake assembly substantially into the condition shown in FIG. 15. Thus after release of the handle further, undesired, movement of the draw bar in the retraction direction of the screen will be prevented by the brake assembly 20.

A particular embodiment has been illustrated and described by way of example.

Any desired and suitable materials could be used for the parts described and illustrated. In a particular embodiment, the housing 30, brake member 50, link members 90, 90A, latch member 110 and moveable seat 120 are made from suitable plastics. These parts may be manufactured, for example, solely or primarily by injection moulding. The spring 70 and connecting pin 46 may be made from metal such as a suitable types of steel.

In a particular embodiment, the brake pad 51 is made from, or comprises, a SEBS (Styrene Ethylene Butylene Styrene) polymer material, and may be co-moulded (injection moulded) onto the brake shoe 53 (or more generally the rest of the brake member 50). SEBS is considered suitable due to its appropriate frictional and abrasion-resistant characteristics and its suitability for co-moulding onto the brake shoe 53 (or more generally the rest of the brake member 50), which may be made from polypropylene. Although not visible in the drawings, the brake shoe may include fins, ribs or other projections extending from the inner surfaces of one or more of the wall portions 53A, 54, 55, to increase contact surface area with the brake pad and enhance adhesive and/or mechanical bonding with the brake pad material.

In relation to the brake pad, it will be appreciated that alternative materials and attachment methods may be used: for example, the brake pad 51 may be made from any suitable material (including particularly, but not necessarily exclusively, polymer, elastomer, thermoplastic and/or rubber) and attached to the brake shoe 53 (or more generally the rest of the brake member 50) by any suitable arrangement.

It will be appreciated that at least the illustrated embodiment of a brake arrangement can assist significantly in securing a draw bar against inadvertent movement in the retraction direction by the force applied by the biased roller.

The illustrated embodiment can assist in overcoming a lack of braking force which can afflict prior art brake arrangements which rely substantially solely on a bias force provided by a spring to force a brake against a guide track of a blind.

The illustrated embodiment can provide sufficient braking force without requiring an unduly strong biasing spring that would be stiff to release. This can provide a number of advantages, including: ease and pleasantness of use, due to only a relatively light force needing to be manually applied to the handle to release the brake; reduced strain on release cable/handle components, especially during release, thereby increasing component life and reliability and/or allowing use of lighter and/or more economical components; and reduced resistance by the latch member to riding over the catch.

Compared to use of a brake arrangement similar in structure to the illustrated embodiment but without the force-increasing mechanism, the illustrated embodiment can provide increased braking force against movement in the retraction direction of the screen, which can assist in overcoming or mitigating reduced friction between the brake pad and the track that may occur during use, for example due to contamination wear or aging of the brake surface, moisture on the guide track, or other circumstances.

Further, the illustrated embodiment provides a mechanism in which the same releasing action is required of a user, irrespective of whether latch is engaged on the catch, or not.

As braking force needs to only resist movement of the draw bar in the opening (retraction) direction, it is an elegant solution to provide a brake arrangement which provides a greater breaking force in this direction than in the closing direction.

Of course, the above features or functionalities described in relation to the disclosed embodiments are provided by way of example only, and should not be taken as a necessary or provided by all embodiments of the invention.

Modifications and improvements may be incorporated without departing from the scope of the invention.

The invention claimed is:

1. A draw bar for a retractable screen arrangement in which a screen material is extensible across an opening by movement of the draw bar in an extension direction in order to screen or partially screen the opening, and in which the screen material is retractable by movement of the draw bar in a retraction direction, to reduce occlusion of the opening by the screen material and in which the screen arrangement applies a retraction force, in the retraction direction, to the screen material to assist retraction of the screen material;

the draw bar comprising:

a brake arrangement for providing a braking force between the draw bar and a bearing surface of a track which in use guides the draw bar, to resist relative movement of the brake arrangement and the bearing surface in at least one direction, the brake arrangement comprising:

a brake member which provides a friction surface for contacting the bearing surface;

a brake member support for supporting the brake member and allowing the brake member to be movably disposed within the brake member support; and a forcing arrangement for forcing the friction surface against the bearing surface;

wherein the forcing arrangement comprises: a biasing arrangement for biasing the friction surface towards the bearing surface, and a force-increasing arrangement for increasing the force with which the friction surface engages the bearing surface resulting from movement or forcing of the drawbar in the retraction direction, wherein the force-increasing arrangement comprises at least one link member having a first linking region and a second linking region with an intermediate region therebetween, the first linking region being pivotably coupled to the brake member support and the second linking region being pivotably coupled to the brake member such that the braking force resulting from engagement of the friction surface with the bearing surface as a result of the movement or forcing of the draw bar in the retraction direction results in the link member transmitting force from the brake member support to the brake member to force the brake member towards a fully extended position.

2. The draw bar of claim 1, wherein the force increasing arrangement is configured to increase the force with which the friction surface engages the bearing surface by converting at least some of a frictional force applied between the friction surface and the bearing surface into additional contact pressure force applied to the brake member to increase contact pressure between the friction surface and the bearing surface.

3. The draw bar of claim 1, wherein at least part of the at least one link member is angled relative to the extension direction.

4. The draw bar of claim 1, wherein the at least one link member couples the brake member to the brake member support so that movement of at least the friction surface of the brake member relative to the brake member support is constrained by the at least one link member to movement which has a component in an extension-retraction direction and a component towards or away from the bearing surface.

5. The draw bar of claim 1, wherein the at least one link member couples the brake member to the brake member support so that movement of at least the friction surface of the brake member relative to the brake member support is constrained by the at least one link member to movement which has a component in an axial direction of the brake member support, and a component in perpendicular to the axial direction of the brake member support.

6. The draw bar of claim 1, wherein the at least one link member couples the brake member to the brake member support so that movement of at least the friction surface of the brake member relative to the brake member support is constrained by the at least one link member to movement which follows a curved path.

7. The draw bar of claim 1, wherein the at least one link member defines a substantially arcuate path, relative to a part of the brake support member, along which movement of a part of the brake member is constrained.

8. The draw bar of claim 1, wherein the at least one link member defines a substantially fixed distance between a part of the brake member and a part of the brake member support.

9. The draw bar of claim 1, wherein the at least one link member is offset laterally from the friction surface.

10. The draw bar of claim 1, wherein the at least one link member is provided towards each lateral side of a brake assembly.

11. The draw bar of claim 1, wherein each lateral side of the friction surface is provided on one of the at least one link member.

12. The draw bar of claim 1, wherein the brake arrangement further comprises a latch arrangement, for engagement with a catch provided adjacent the bearing surface and the latch arrangement comprises a latch member moveable by the brake member from a latching position to a disengaged position.

13. The draw bar of claim 1, wherein a latch is configured to be moved into a disengaged position when a friction surface is moved into a withdrawn position.

14. The draw bar of claim 3, wherein when a frictional force between the bearing surface and the friction surface is applied to the at least one link member in the extension direction, the at least one link member provides a reaction force which forces the friction surface onto the bearing surface.

15. The draw bar of claim 7, wherein the part of the brake member that is constrained is a connection part and the connection part is adjacent the friction surface.

16. The draw bar of claim 15, wherein the connection part of the brake member is a projection, which in use is connected to an aperture provided on the at least one link member.

17. The draw bar of claim 16, wherein the brake member includes an actuating part that extends away from the friction surface and is controllable by a user to move the friction surface away from the bearing surface, against a force applied by the biasing arrangement.

18. The draw bar of claim 17, wherein the movement of the actuating part is guided by a passage provided in the brake member support.

* * * * *